US011822286B2

(12) United States Patent
Kenmoku et al.

(10) Patent No.: US 11,822,286 B2
(45) Date of Patent: Nov. 21, 2023

(54) PROCESS CARTRIDGE AND ELECTROPHOTOGRAPHIC APPARATUS

(71) Applicant: CANON KABUSHIKI KAISHA, Tokyo (JP)

(72) Inventors: Takashi Kenmoku, Shizuoka (JP); Kunihiko Sekido, Shizuoka (JP); Kozue Uratani, Shizuoka (JP); Koki Inoue, Shizuoka (JP); Tatsuya Saeki, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/935,721

(22) Filed: Sep. 27, 2022

(65) Prior Publication Data

US 2023/0114583 A1 Apr. 13, 2023

(30) Foreign Application Priority Data

Oct. 8, 2021 (JP) ..... 2021-166515
Aug. 16, 2022 (JP) ..... 2022-129653
Sep. 15, 2022 (JP) ..... 2022-147173

(51) Int. Cl.
*G03G 21/16* (2006.01)
*G03G 9/093* (2006.01)
(Continued)

(52) U.S. Cl.
CPC ..... *G03G 9/09328* (2013.01); *G03G 9/0819* (2013.01); *G03G 9/0823* (2013.01);
(Continued)

(58) Field of Classification Search
CPC .. G03G 9/0819; G03G 9/0823; G03G 9/0827; G03G 9/09328; G03G 9/09708; G03G 21/1814
See application file for complete search history.

(56) References Cited

U.S. PATENT DOCUMENTS 6,777,153 B2 8/2004 Yano
6,808,907 B2 10/2004 Honma
(Continued)

FOREIGN PATENT DOCUMENTS

JP 2009-229495 A 10/2009
JP 2010-249995 A 11/2010
JP 2020-106723 A 7/2020

OTHER PUBLICATIONS

U.S. Appl. No. 17/814,089, filed Jul. 21, 2022, Masatake Tanaka.
(Continued)

*Primary Examiner* — Hoang X Ngo
(74) *Attorney, Agent, or Firm* — VENABLE LLP

(57) ABSTRACT

Provided are a process cartridge and an electrophotographic apparatus each capable of suppressing an image defect (coarseness in a halftone image) caused by toner scattering in association with a charging failure that occurs when the process speed of the electrophotographic apparatus is further increased. The process cartridge includes: an electrophotographic photosensitive member; and a developing unit, which includes a toner storing portion that stores a toner, and which supplies the toner to a surface of the electrophotographic photosensitive member. The electrophotographic photosensitive member includes a surface protective layer containing an electroconductive particle in an appropriate amount, and the volume resistivity of the surface protective layer is controlled. As the toner, there is used a toner in which an organosilicon polymer is present on the surface of a toner particle, a silanol group is present in part of the organosilicon polymer, and the amount of the silanol group is controlled.

13 Claims, 3 Drawing Sheets

(51) Int. Cl.
*G03G 9/08* (2006.01)
*G03G 21/18* (2006.01)
*G03G 9/097* (2006.01)

(52) U.S. Cl.
CPC ..... *G03G 9/0827* (2013.01); *G03G 9/09708* (2013.01); *G03G 21/1814* (2013.01)

(56) References Cited

U.S. PATENT DOCUMENTS 6,908,721 B2 6/2005 Kenmoku
6,911,520 B2 6/2005 Fukui
7,045,321 B2 5/2006 Imamura
7,393,912 B2 7/2008 Mihara
7,399,568 B2 7/2008 Fukui
7,408,017 B2 8/2008 Imamura
7,452,960 B2 11/2008 Yano
7,510,813 B2 3/2009 Yano
7,638,194 B2 12/2009 Fukui
7,638,590 B2 12/2009 Fukui
7,682,765 B2 3/2010 Sugawa
7,795,363 B2 9/2010 Fukui
7,935,771 B2 5/2011 Fukui
8,067,136 B2 11/2011 Yano
8,093,342 B2 1/2012 Minami
8,110,329 B2 2/2012 Tominaga
8,178,271 B2 5/2012 Fukui
8,383,312 B2 2/2013 Fujimoto
8,574,801 B2 11/2013 Itabashi
8,609,312 B2 12/2013 Itabashi
8,828,633 B2 9/2014 Itabashi
8,918,035 B2 12/2014 Hasegawa
9,029,056 B2 5/2015 Kenmoku
9,098,002 B2 8/2015 Kenmoku
9,098,003 B2 8/2015 Masumoto
9,244,371 B2 1/2016 Suzumura
9,304,422 B2 4/2016 Matsui
9,348,246 B2 5/2016 Magome
9,354,545 B2 5/2016 Matsui
9,377,708 B2 6/2016 Magome
9,423,711 B2 8/2016 Uratani
9,423,714 B2 8/2016 Kenmoku
9,442,416 B2 9/2016 Magome
9,625,842 B2 4/2017 Uratani
9,658,546 B2 5/2017 Tanaka
9,804,514 B2 10/2017 Suzumura
9,841,692 B2 12/2017 Hasegawa
9,857,707 B2 1/2018 Tsuda
9,964,874 B2 5/2018 Suzumura
10,114,303 B2 10/2018 Katsura
10,228,627 B2 3/2019 Nagashima
10,241,430 B2 3/2019 Kimura
10,289,016 B2 5/2019 Fukudome
10,295,921 B2 5/2019 Ohmori
10,310,397 B2 6/2019 Sano
10,578,990 B2 3/2020 Tsuda
10,698,327 B2 6/2020 Nagashima
10,747,134 B2 8/2020 Watanabe
10,747,136 B2 8/2020 Kenmoku
10,768,540 B2 9/2020 Watanabe
10,782,623 B2 9/2020 Yoshiba
10,852,650 B2 12/2020 Inoue
10,969,704 B2 4/2021 Kagawa
11,112,708 B2 9/2021 Uratani
11,112,709 B2 9/2021 Saeki
11,112,713 B2 9/2021 Akiyama
11,169,458 B2 11/2021 Toyoizumi
11,175,600 B2 11/2021 Uchiyama
11,256,187 B2 2/2022 Ogaki
11,314,178 B2 4/2022 Kenmoku
11,347,157 B2 5/2022 Kamikura
11,467,510 B2 10/2022 Terui
11,531,282 B2 12/2022 Kamikura
11,599,036 B2 * 3/2023 Inoue ..... G03G 9/097
2005/0054063 A1 3/2005 Honma
2005/0260514 A1 11/2005 Mihara
2006/0194071 A1 8/2006 Yano
2012/0172562 A1 7/2012 Kenmoku
2015/0185648 A1 7/2015 Uratani
2016/0378003 A1 12/2016 Arimura
2019/0235406 A1 * 8/2019 Yamawaki ..... G03G 9/09725
2020/0209766 A1 7/2020 Yamawaki
2021/0063902 A1 3/2021 Inoue
2021/0318630 A1 * 10/2021 Terui ..... G03G 9/08755
2021/0373450 A1 12/2021 Kawaguchi
2021/0382406 A1 12/2021 Yamashita
2021/0405549 A1 12/2021 Ookubo
2022/0026821 A1 1/2022 Amano
2022/0128916 A1 4/2022 Yoshida
2022/0128918 A1 4/2022 Kototani
2022/0146952 A1 5/2022 Komiya
2022/0146955 A1 5/2022 Nozaki
2022/0206402 A1 6/2022 Uratani
2022/0214629 A1 7/2022 Kenmoku
2022/0214630 A1 7/2022 Kamikura
2022/0291601 A1 9/2022 Katsura
2022/0413407 A1 12/2022 Inoue
2023/0004099 A1 1/2023 Seino

OTHER PUBLICATIONS

U.S. Appl. No. 17/814,143, filed Jul. 21, 2022, Tatsuya Saeki.
U.S. Appl. No. 17/936,104, filed Sep. 28, 2022, Tatsuya Saeki.
U.S. Appl. No. 17/936,943, filed Sep. 30, 2022, Kozue Uratani.
U.S. Appl. No. 18/046,585, filed Oct. 14, 2022, Yuta Komiya.
U.S. Appl. No. 18/046,590, filed Oct. 14, 2022, Kosuke Fukudome.
U.S. Appl. No. 18/053,846, filed Nov. 9, 2022, Kenta Kamikura.

* cited by examiner

PROCESS CARTRIDGE AND ELECTROPHOTOGRAPHIC APPARATUS

BACKGROUND OF THE INVENTION

Field of the Invention

The present invention relates to a process cartridge and an electrophotographic apparatus each including an electrophotographic photosensitive member.

Description of the Related Art

In an electrophotographic apparatus (hereinafter sometimes referred to as "image forming apparatus"), an increase in speed, downsizing, and extension of life have been demanded. In correspondence with the foregoing, an increase in durability that can withstand an increase in speed and performance for stabilizing image quality with long life have been further required in a toner.

Space-saving of various units has been attempted from the viewpoint of downsizing. In particular, when the transferability of a toner is improved, a waste toner container that collects a transfer residual toner on a photosensitive drum can be downsized, and hence various attempts for improving the transferability have been made.

In a transfer step, a toner on a photosensitive drum is transferred onto a medium such as paper. In order to improve the transferability, it is important to decrease the adhesive force between the photosensitive drum and the toner so as to facilitate the separation of the toner from the photosensitive drum. As a technology therefor, there has been known a technology for externally adding large-particle-diameter silica particles each having a particle diameter of from about 100 nm to about 300 nm.

Meanwhile, when the large-particle-diameter silica particles are externally added, the fluidity of the toner is decreased. As a result, there arises a problem in chargeability, in particular, chargeability at the time of charge rising or under a high-temperature and high-humidity environment.

In order to solve the above-mentioned problem, in Japanese Patent Application Laid-Open No. 2010-249995, there is a disclosure of a toner that is intended to achieve both of: an improving effect of small-particle-diameter silica particles on chargeability and fluidity; and a suppressing effect of large-particle-diameter silica particles on the embedding of silica particles.

In Japanese Patent Application Laid-Open No. 2020-106723, there is a disclosure of a toner in which all of the improvement of transferability, excellent fluidity, and the property of suppressing contamination of members can be satisfied by using organosilicon polymer fine particles each having a specified particle diameter together with large-particle-diameter silica particles and further controlling the large-particle-diameter silica particles and the organosilicon polymer fine particles so that those particles each have a specific sticking rate to toner particles.

In Japanese Patent Application Laid-Open No. 2009-229495, there is a disclosure of an electrophotographic photosensitive member that can maintain stable electrical characteristics even under an environment such as a high-temperature and high-humidity environment, together with the mechanical strength of a protective layer on the surface of the electrophotographic photosensitive member by incorporating anatase-type titanium oxide containing niobium atoms into the protective layer of the electrophotographic photosensitive member.

SUMMARY OF THE INVENTION

In the configuration described in Japanese Patent Application Laid-Open No. 2010-249995, the durability performance is improved by the large-particle-diameter silica particles, but there are problems in chargeability of the toner and durability in the latter half of the duration.

In the configuration described in Japanese Patent Application Laid-Open No. 2020-106723, the durability in the latter half of the duration is certainly improved. However, the inventors of the present invention have further made extensive investigations, and as a result, have recognized that, when the process speed of an image forming apparatus is increased, the charge quantity of part of the toner developed onto an electrophotographic photosensitive member is low, and the part of the toner scatters. From the foregoing, it has been found that, particularly when a halftone image is formed, the toner having a charging failure scatters to cause coarseness in the halftone image.

In the configuration described in Japanese Patent Application Laid-Open No. 2009-229495, the mechanical strength of the surface protective layer is certainly improved. However, the inventors of the present invention have further made extensive investigations, and as a result, have recognized that, when the process speed of an image forming apparatus is increased, there is room for improvement of coarseness in a halftone image. It is conceived that the coarseness occurs because there is no mechanism for injecting charge from the electrophotographic photosensitive member into the toner to increase the charge quantity of the toner and sharpen the charge quantity distribution of the toner.

The above-mentioned object is achieved by the present invention described below.

A process cartridge of the present invention is a process cartridge that is detachable from a main body of an electrophotographic apparatus, the process cartridge including: an electrophotographic photosensitive member; and a developing unit, which includes a toner storing portion configured to store a toner, and which is configured to supply the toner to a surface of the electrophotographic photosensitive member, wherein the electrophotographic photosensitive member includes an electroconductive support, and a photosensitive layer and a surface protective layer formed on the electroconductive support in the stated order, wherein the surface protective layer contains an electroconductive particle, wherein a content of the electroconductive particle is 5.0 vol % or more and 70.0 vol % or less with respect to a total volume of the surface protective layer, wherein the surface protective layer has a volume resistivity of $1.0\times10^{9}$ Ω·cm or more and $1.0\times10^{14}$ Ω·cm or less, wherein the toner stored in the toner storing portion satisfies one of the following provision (i) or (ii): (i) a toner including a toner particle that contains a binder resin and including an organosilicon polymer particle; and (ii) a toner including a toner particle that contains the binder resin and includes an organosilicon polymer on a surface thereof, wherein one of the organosilicon polymer particle in a case of satisfying the provision (i) or the organosilicon polymer in a case of satisfying the provision (ii) includes: a silicon atom having a T3 unit structure; and at least one unit structure selected from the group consisting of: a silicon atom having a T2 unit structure; and a silicon atom having a T1 unit structure, and wherein, in $^{29}$Si-NMR measurement of one of the organosilicon polymer particle in the case of satisfying the provision (i) or the organosilicon polymer in the case of satisfying the provision (ii), a ratio of a total area of an area of a peak derived from the silicon atom having the T2 unit structure and an area of a peak derived from the silicon atom having the T1 unit structure with respect to a total area of peaks derived from all the silicon atoms is 0.10 or more and 0.40 or less.

Thus, according to the present invention, the process cartridge and the electrophotographic apparatus capable of suppressing an image defect (coarseness in a halftone image) caused by toner scattering in association with a charging failure that occurs when the process speed of the electrophotographic apparatus is further increased, while improving transferability, can be provided.

Further features of the present invention will become apparent from the following description of exemplary embodiments with reference to the attached drawings.

DESCRIPTION OF THE EMBODIMENTS

Figure 1:
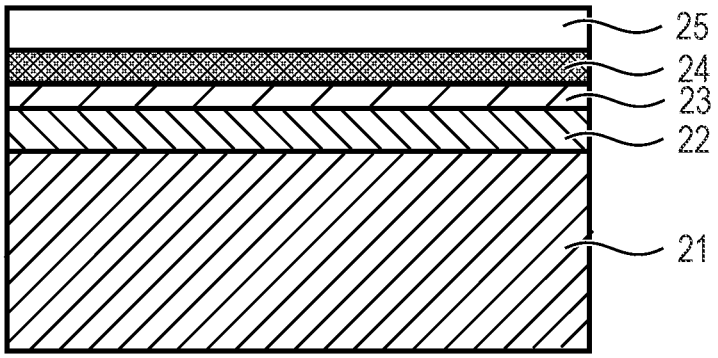
FIG. 1 is a schematic view for illustrating an example of a configuration of an electrophotographic photosensitive member according to the present invention.

A process cartridge of the present invention is a process cartridge that is detachable from a main body of an electrophotographic apparatus, the process cartridge including: an electrophotographic photosensitive member; and a developing unit, which includes a toner storing portion configured to store a toner, and which is configured to supply the toner to a surface of the electrophotographic photosensitive member, wherein the electrophotographic photosensitive member includes an electroconductive support, and a photosensitive layer and a surface protective layer formed on the electroconductive support in the stated order, wherein the surface protective layer contains an electroconductive particles, wherein a content of the electroconductive particles is 5.0 vol % or more and 70.0 vol % or less with respect to a total volume of the surface protective layer, wherein the surface protective layer has a volume resistivity of $1.0\times10^{9}$ Ω·cm or more and $1.0\times10^{14}$ Ω·cm or less, wherein the toner stored in the toner storing portion satisfies one of the following provision (i) or (ii): (i) a toner including a toner particle that contains a binder resin and including an organosilicon polymer particle; and (ii) a toner including a toner particle that contains a binder resin and includes an organosilicon polymer on a surface thereof, wherein one of the organosilicon polymer particle in a case of satisfying the provision (i) or the organosilicon polymer in a case of satisfying the provision (ii) includes: a silicon atom having a T3 unit structure; and at least one unit structure selected from the group consisting of: a silicon atom having a T2 unit structure; and a silicon atom having a T1 unit structure, and wherein, in $^{29}$Si-NMR measurement of one of the organosilicon polymer particle in the case of satisfying the provision (i) or the organosilicon polymer in the case of satisfying the provision (ii), a ratio of a total area of an area of a peak derived from the silicon atom having the T2 unit structure and an area of a peak derived from the silicon atom having the T1 unit structure with respect to a total area of peaks derived from all the silicon atoms is 0.10 or more and 0.40 or less.

The inventors of the present invention have made investigations on a method of suppressing an image defect (coarseness in a halftone image) caused by toner scattering in association with a charging failure that occurs when the process speed of an image forming apparatus is further increased, while improving transferability with the process cartridge.

The inventors of the present invention have recognized that the above-mentioned phenomenon occurs for the following reason: when the process speed of the image forming apparatus is increased, the charge quantity of part of a toner developed onto the electrophotographic photosensitive member is low, and the part of the toner scatters. As a result, it has been found that, particularly when a halftone image is formed, a toner having a charging failure scatters to cause coarseness in the halftone image.

In view of the foregoing, from the viewpoint of injecting a small part of charge on the surface of the electrophotographic photosensitive member into the toner to increase the charge quantity of the toner and sharpen the charge quantity distribution thereof immediately before the toner is developed from a developer carrying member onto the electrophotographic photosensitive member, the inventors of the present invention have made extensive investigations on a process cartridge capable of suppressing an image defect (coarseness in a halftone image) caused by toner scattering in association with a charging failure that occurs when the process speed of the image forming apparatus is further increased.

The inventors of the present invention have enabled a small part of the charge on the surface of the photosensitive member to be injected into the toner at the time of development by incorporating an appropriate amount of the electroconductive particle into the surface of the surface protective layer of the photosensitive member and controlling the volume resistivity of the surface protective layer of the photosensitive member. Further, the inventors of the present invention have enabled the charge on the surface of the electrophotographic photosensitive member to be rapidly injected into the toner through the organosilicon polymer to increase the charge quantity of the toner and sharpen the charge quantity distribution thereof by causing the organosilicon polymer to be present on the surfaces of the toner particles, causing silanol groups to be present in part of the organosilicon polymer, and controlling the amount of the silanol groups.

It has been found that, with the above-mentioned process cartridge, a charging failure that occurs when the process speed of the image forming apparatus is further increased can be suppressed, to thereby suppress an image defect (coarseness in a halftone image) caused by toner scattering, while the transferability is maintained.

<Photosensitive Member According to the Present Invention>

The photosensitive member according to the present invention includes an electroconductive support, a photosensitive layer, and a surface protective layer. The surface protective layer contains an electroconductive particle, and the content of the electroconductive particle is 5.0 vol % or more and 70.0 vol % or less with respect to the total volume of the surface protective layer. Further, the photosensitive member is characterized in that the surface protective layer has a volume resistivity of $1.0\times10^{9}$ Ω·cm or more and $1.0\times10^{14}$ Ω·cm or less. The volume resistivity is maintained at a relatively high level in spite of the fact that the surface protective layer contains a large amount of the electroconductive particle, and hence the charge can be injected into the toner according to the present invention through the electroconductive particle while the charge retention property is ensured.

When the content of the electroconductive particle is less than 5.0 vol %, the charge injection property to the toner according to the present invention is lowered, and hence an image defect (coarseness in a halftone image) caused by toner scattering becomes liable to occur due to the charging failure at the time of development that occurs when the process speed is increased. Meanwhile, when the content is more than 70.0 vol %, the surface protective layer itself becomes brittle, and hence the surface of the photosensitive member becomes liable to be scraped off through a long-term use. As a result, the charging uniformity of the photosensitive member is lowered, and an image defect caused by toner scattering becomes liable to occur due to the charging failure at the time of development that occurs when the process speed is increased. The content of the electroconductive particle is more preferably 5.0 vol % or more and 40.0 vol % or less. When the content is set to within the preferred range, fogging under a high-temperature and high-humidity environment also becomes satisfactory.

In addition, the photosensitive member is characterized in that the surface protective layer has a volume resistivity of $1.0\times10^{9}$ Ω·cm or more and $1.0\times10^{14}$ Ω·cm or less. When the volume resistivity is less than $1.0\times10^{9}$ Ω·cm, the resistance of the surface protective layer is too low, and it becomes difficult to maintain the potential, resulting in a decrease in charge quantity of the toner. As a result, the effects of the present invention are not obtained, and fogging under a high-temperature and high-humidity environment deteriorates. When the volume resistivity is more than $1.0\times10^{14}$ Ω·cm, the resistance of the surface protective layer is too high, and the injection chargeability to the toner significantly deteriorates. As a result, the effects of the present invention are not obtained, and fogging deteriorates due to the charging failure caused by electrostatic aggregation between toner particles under a low-temperature and low-humidity environment.

The volume resistivity of the surface protective layer is preferably $1.0\times10^{11}$ Ω·cm or more and $1.0\times10^{14}$ Ω·cm or less. The volume resistivity of the surface protective layer may be controlled by, for example, the particle diameter of each of the electroconductive particle. The particle diameter of each of the electroconductive particle is preferably 5 nm or more and 300 nm or less, more preferably 40 nm or more and 250 nm or less in terms of number-average particle diameter. When the number-average particle diameter of the electroconductive particle is less than 5 nm, the specific surface area of the electroconductive particle is increased, and water adsorption is increased in the vicinity of the electroconductive particle on the surface of the surface protective layer, with the result that the volume resistivity of the surface protective layer becomes liable to be decreased. When the number-average particle diameter of the electroconductive particle is more than 300 nm, the dispersion of the particles in the surface protective layer deteriorates, and the area of the interface with the binder resin is reduced, with the result that the resistance at the interface is increased, and the charge injection property becomes liable to deteriorate.

Examples of the electroconductive particle contained in the surface protective layer include particles of a metal oxide, such as titanium oxide, zinc oxide, tin oxide, or indium oxide. When the metal oxide is used as the electroconductive particle, the metal oxide may be doped with an element, such as niobium, phosphorus, or aluminum, or an oxide thereof. In the present invention, titanium oxide is preferred from the viewpoint of a charge injection property from a charging member.

Further, when titanium oxide contains niobium atoms, the injection property becomes more satisfactory, and the charge injection property can be improved by a small amount of the titanium oxide. The content of the niobium atoms is preferably 0.5 mass % or more and 15.0 mass % or less, more preferably 2.6 mass % or more and 10.0 mass % or less with respect to the total mass of the niobium atom-containing titanium oxide particles.

The electroconductive particles are particularly preferably titanium oxide particles each of which contains niobium, and has a configuration in which niobium is localized in the vicinity of the surface of the particle. This is because the localization of niobium in the vicinity of the surface enables efficient transfer of a charge. More specifically, in each of the titanium oxide particles, a concentration ratio calculated as "niobium atom concentration/titanium atom concentration" at an inside portion at 5% of the maximum diameter of the particle from the surface of the particle is 2.0 or more times as high as a concentration ratio calculated as "niobium atom concentration/titanium atom concentration" at the center of the particle. In such state, the charge can be efficiently transferred as described above. As a result, the charge injection property to the toner can be improved. In addition, a decrease in volume resistivity of the surface protective layer can be suppressed. As a result, in addition to the effects of the present invention, fogging under a high-temperature and high-humidity environment becomes satisfactory from the initial stage to the final stage of the duration. The niobium atom concentration and the titanium atom concentration are obtained through use of a scanning transmission electron microscope (STEM) having connected thereto an EDS analyzer (energy-dispersive X-ray spectrometer).

Figure 4:
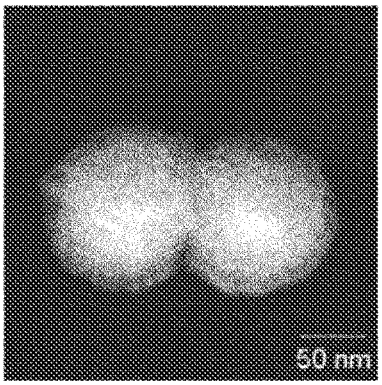
FIG. 4 is a TEM image of an example of niobium-containing titanium oxide used in Examples of the present invention.

A STEM image of an example (X1) of titanium oxide particles used in Examples of the present invention is shown in FIG. 4.

Figure 5:
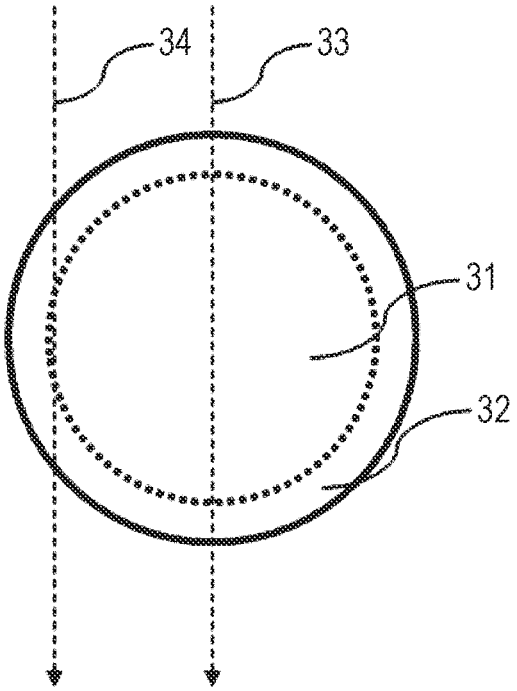
FIG. 5 is a schematic view of an example of niobium-containing titanium oxide used in Examples of the present invention.

In addition, the STEM image of FIG. 4 is schematically illustrated in FIG. 5.

The niobium-containing titanium oxide particles used in the present invention may be produced by coating titanium oxide particles serving as a core with niobium-containing titanium oxide and then calcining the resultant. It is conceived that the coating niobium-containing titanium oxide undergoes crystal growth as niobium-doped titanium oxide by so-called epitaxial growth along crystals of the titanium oxide serving as the core. As shown in FIG. 4, it is understood that the niobium-containing titanium oxide produced in this manner has a lower density in the vicinity of the surface, as compared to the density in a particle central portion, and has a core-shell-like form. In addition, in EDS analysis with the STEM, X-rays penetrate through the entire particle, and hence, as illustrated in FIG. 5, the EDS analysis at an inside portion at 5% of a primary particle diameter from the surface of the particle is more influenced by a surface vicinity 32, as compared to the EDS analysis in a particle central portion 31. In addition, FIG. 5 is a schematic view for illustrating an irradiation image of X-rays 33 for analyzing the central portion of the electroconductive particle and X-rays 34 for analyzing an inside portion at 5% of the maximum diameter of the measurement particle from the surface of the particle.

The niobium atom-containing titanium oxide particles are preferably anatase-type or rutile-type titanium oxide particles, more preferably anatase-type titanium oxide particles. When anatase-type titanium oxide is used, the movement of a charge in the surface protective layer is facilitated, and hence charge injection becomes satisfactory.

The anatase-type titanium oxide particles may be produced by a known sulfuric acid method. That is, the anatase-type titanium oxide particles are obtained by: heating a solution containing titanium sulfate and titanyl sulfate to hydrolyze the contents, to thereby produce a hydrous titanium dioxide slurry; and subjecting the titanium dioxide slurry to dehydration calcination.

The anatase-type titanium oxide has a degree of anatase conversion of preferably from 90% to 100%. In the surface protective layer containing a niobium atom-containing anatase-type titanium oxide within the range defined by the present invention, the rectifying property is achieved satisfactorily and stably, and the above-mentioned effects of the present invention are satisfactorily achieved. Herein, the degree of anatase conversion is a value determined from the following expression by measuring an intensity IA of a strongest interference line of anatase (plane index: 101) and an intensity IR of a strongest interference line of rutile (plane index: 110) in powder X-ray diffraction of titanium oxide.

$$\text{Degree of anatase conversion (\%)} = 100/(1+1.265\times IR/IA)$$

In order to produce anatase-type titanium oxide having a degree of anatase conversion within a range of from 90% to 100%, in the production of titanium oxide, a solution containing titanium sulfate and titanyl sulfate as titanium compounds is heated to be hydrolyzed to produce a hydrous titanium dioxide slurry, and the titanium dioxide slurry is subjected to dehydration calcination. Thus, the anatase-type titanium oxide is obtained. In this method, anatase-type titanium oxide having a degree of anatase conversion of approximately 100% is obtained. Alternatively, anatase-type titanium oxide having a high degree of anatase conversion is also obtained by neutralizing a titanium tetrachloride aqueous solution through use of an alkali.

<Toner According to the Present Invention>

The toner according to the present invention satisfies one of the following provision (i) or (ii):

(i) a toner including a toner particle that contains a binder resin and including an organosilicon polymer particle; and (ii) a toner including a toner particle that contains the binder resin and includes an organosilicon polymer on a surface thereof.

One of the organosilicon polymer particle in a case of satisfying the provision (i) or the organosilicon polymer in a case of satisfying the provision (ii) includes: a silicon atom having a T3 unit structure; and at least one unit structure selected from the group consisting of: a silicon atom having a T2 unit structure; and a silicon atom having a T1 unit structure.

Further, in the $^{29}$Si-NMR measurement of one of the organosilicon polymer particle in the case of satisfying the provision (i) or the organosilicon polymer in the case of satisfying the provision (ii), a ratio of a total area of an area of a peak derived from the silicon atom having the T2 unit structure and an area of a peak derived from the silicon atom having the T1 unit structure with respect to a total area of peaks derived from all the silicon atoms is 0.10 or more and 0.40 or less.

The silicon atom having the T1 unit structure is a silicon atom that is bonded to one atom other than oxygen and three oxygen atoms, in which only one of the three oxygen atoms is further bonded to another silicon atom. In general, the silicon atom having the T1 unit structure is a silicon atom having a structure represented by $RaSi(O_{1/2})(OR)_2$.

The silicon atom having the T2 unit structure is a silicon atom that is bonded to one atom other than oxygen and three oxygen atoms, in which only two of the three oxygen atoms are further bonded to other silicon atoms. In general, the silicon atom having the T2 unit structure is a silicon atom having a structure represented by $RaSi(O_{1/2})_2(OR)$.

The silicon atom having the T3 unit structure is a silicon atom that is bonded to one atom other than oxygen and three oxygen atoms, in which all of the three oxygen atoms are further bonded to other silicon atoms. In general, the silicon atom having the T3 unit structure is a silicon atom having a structure represented by $RaSi(O_{1/2})_3$.

For example, Ra represents an alkyl group having 1 to 6 carbon atoms or a phenyl group, and R represents a hydrogen atom or an alkyl group having 1 to 6 carbon atoms.

The case of the provision (i) a toner including a toner particle that contains a binder resin and including an organosilicon polymer particle is described.

<Organosilicon Polymer Particle>

In the above-mentioned configuration, when the toner having organosilicon polymer particles on the surface is used, a method of forming the organosilicon polymer particles is not particularly limited, and conventionally known methods may be used. The above-mentioned method is described below.

It is an essential configuration that the organosilicon polymer particles have a structure in which silicon atoms and oxygen atoms are alternately bonded to each other, and the organosilicon polymer has at least one unit structure selected from the group consisting of: the silicon atom having the T3 unit structure; the silicon atom having the T2 unit structure; and the silicon atom having the T1 unit structure.

The method of producing the organosilicon polymer particles in the above-mentioned configuration is not particularly limited, and the organosilicon polymer particles are obtained by, for example, dropping a silane compound represented by the following formula (Z) onto water, subjecting the resultant to hydrolysis and condensation reaction with a catalyst, and then filtering and drying the resultant suspension. As the catalyst, examples of acidic catalysts include hydrochloric acid, hydrofluoric acid, sulfuric acid, and nitric acid, and examples of basic catalysts include ammonia water, sodium hydroxide, and potassium hydroxide. However, the catalyst is not limited thereto.

Formula (Z)

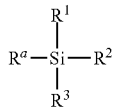

(Z)

In the formula (Z), $R^a$ represents an organic functional group. $R^1$, $R^2$, and $R^3$ each independently represent a halogen atom, a hydroxy group, an acetoxy group, or an alkoxy group (preferably having 1 or more and 3 or less carbon atoms.

Examples of $R^a$ include a hydrocarbon group (preferably an alkyl group) or an aryl group (preferably a phenyl group) having 1 or more and 6 or less (preferably 1 to 3, more preferably 1 or 2) carbon atoms.

$R^1$, $R^2$, and $R^3$ each independently represent a halogen atom, a hydroxy group, an acetoxy group, or an alkoxy group. Those groups are reactive groups that undergo hydrolysis, addition polymerization, and condensation to form crosslinked structures. In addition, the hydrolysis, addition polymerization, and condensation of $R^1$, $R^2$, and $R^3$ can be controlled by the reaction temperature, reaction time, reaction solvent, and pH. An organosilicon compound having three reactive groups ($R^1$, $R^2$, and $R^3$) in one molecule excluding $R^a$ as in the formula (Z) is also called a trifunctional silane.

Examples of the formula (Z) include: trifunctional methylsilanes, such as p-styryltrimethoxysilane, methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane; trifunctional ethylsilanes, such as ethyltrimethoxysilane, ethyltriethoxysilane, ethyltrichlorosilane, ethyltriacetoxysilane, and ethyltrihydroxysilane; trifunctional propylsilanes, such as propyltrimethoxysilane, propyltriethoxysilane, propyltrichlorosilane, propyltriacetoxysilane, and propyltrihydroxysilane; trifunctional butylsilanes, such as butyltrimethoxysilane, butyltriethoxysilane, butyltrichlorosilane, butyltriacetoxysilane, and butyltrihydroxysilane; trifunctional hexylsilanes, such as hexyltrimethoxysilane, hexyltriethoxysilane, hexyltrichlorosilane, hexyltriacetoxysilane, and hexyltrihydroxysilane; and trifunctional phenylsilanes, such as phenyltrimethoxysilane, phenyltriethoxysilane, phenyltrichlorosilane, phenyltriacetoxysilane, and phenyltrihydroxysilane. The organosilicon compounds may be used alone or in combination thereof.

In addition, the following compound may be used together with the organosilicon compound having the structure represented by the formula (Z): an organosilicon compound having four reactive groups in one molecule (a tetrafunctional silane), an organosilicon compound having two reactive groups in one molecule (a bifunctional silane), or an organosilicon compound having one reactive group (a monofunctional silane). The content of the structure represented by the formula (Z) in a monomer forming the organosilicon polymer is preferably 50 mol % or more, more preferably 60 mol % or more.

In the $^{29}$Si-NMR measurement of the organosilicon polymer particle, the ratio of the total area of the area of the peak derived from the silicon atom having the T2 unit structure and the area of the peak derived from the silicon atom having the T1 unit structure with respect to the total area of the peaks derived from all the silicon atoms can be controlled to 0.10 or more and 0.40 or less by the kind of the catalyst, blending ratio, reaction start temperature, dropping time, and the like.

In the $^{29}$Si-NMR measurement, the ratio of the total area of the area of the peak derived from the silicon atom having the T2 unit structure and the area of the peak derived from the silicon atom having the T1 unit structure with respect to the total area of the peaks derived from all the silicon atoms can be controlled to 0.10 or more and 0.40 or less by adjusting the above-mentioned pH, reaction temperature, and reaction time. In the case where the ratio of the total area of the area of the peak derived from the silicon atom having the T2 unit structure and the area of the peak derived from the silicon atom having the T1 unit structure with respect to the total area of the peaks derived from all the silicon atoms is less than 0.10, when charge is injected from the photosensitive member according to the present invention into the toner, the amount of silanol groups (and alkoxysilane groups in part thereof) of the organosilicon polymer particles is small, with the result that the charge injection property is lowered. As a result, an image defect (coarseness in a halftone image) caused by toner scattering becomes liable to occur due to the charging failure at the time of development that occurs when the process speed is increased. In addition, fogging caused by electrostatic aggregation under a low-temperature and low-humidity environment deteriorates.

Meanwhile, in the case where the ratio of the total area is more than 0.40, when charge is injected from the photosensitive member according to the present invention into the toner, the amount of silanol groups (and alkoxysilane groups in a part thereof) of the organosilicon polymer particles is large, and charge leakage becomes liable to occur due to the organosilicon polymer particles, with the result that the charge injection property from the photosensitive member to the toner is lowered. As a result, an image defect (coarseness in a halftone image) caused by toner scattering becomes liable to occur due to the charging failure at the time of development that occurs when the process speed is increased. In addition, fogging under a high-temperature and high-humidity environment deteriorates.

In the $^{29}$Si-NMR measurement of the organosilicon polymer particle, a ratio of an area of a peak derived from the silicon atom having the T3 unit structure with respect to a total area of peaks derived from all the silicon atoms contained in the organosilicon polymer particle is preferably 0.50 or more and 0.90 or less. When the ratio falls within the above-mentioned range, the deterioration of the organosilicon polymer particle itself is suppressed. As a result, when the process speed is increased, the toner particles become less liable to be embedded even at the time of output of a durable image. Accordingly, the charge injection property from the photosensitive member to the toner becomes satisfactory over a long period of time from the initial stage.

The toner is preferably the toner including the toner particle that contains the binder resin and including the organosilicon polymer particle, and the organosilicon polymer particle has a long diameter of preferably 30 nm or more and 300 nm or less.

When the toner is the toner including the organosilicon polymer particle, the organosilicon polymer particle is present on the surface of the toner particle in a state of being able to roll.

As a result, when charge is injected from the photosensitive member into the toner particle via the organosilicon polymer particle, the organosilicon polymer particle rolls on the surface of the toner particle. Thus, the contact area per unit time of the organosilicon polymer particle with the toner particle is increased, and the charge can be efficiently injected from the photosensitive member into the toner.

In addition, when the long diameter is 30 nm or more, the curvature of each of the organosilicon polymer particles becomes small, and the toner particles become less liable to be embedded even at the time of output of a durable image when the process speed is increased. Because of this, the charge injection property from the photosensitive member to the toner becomes satisfactory over a long period of time from the initial stage. Accordingly, an image defect (coarseness in a halftone image) caused by toner scattering can be suppressed over a long period of time from the initial stage. Further, the deterioration of the toner is stably suppressed until the end of the life of the cartridge. As a result, stable fluidity can be maintained from the initial stage to the end of the life of the cartridge. Accordingly, fogging under a high-temperature and high-humidity environment becomes satisfactory from the initial stage to the end of the life of the cartridge.

In addition, when the long diameter is 300 nm or less, the organosilicon polymer particle can be stably present on the surface of the toner particle even when the process speed is increased. In addition, the embedding of the toner particles is suppressed even at the time of output of a durable image. Because of this, the charge injection property from the photosensitive member to the toner becomes satisfactory over a long period of time from the initial stage. Further, the deterioration of the toner can be stably suppressed until the end of the life of the cartridge. As a result, stable fluidity can be maintained from the initial stage to the end of the life of the cartridge. Accordingly, fogging under a high-temperature and high-humidity environment becomes satisfactory from the initial stage to the end of the life of the cartridge.

The organosilicon polymer particle has a sticking rate to the toner particle of preferably 25% or less in a water washing method.

When the sticking rate to the toner particle is 25% or less, most of the organosilicon polymer particles are present in a state of being able to roll on the surfaces of the toner particles. When the organosilicon polymer particles can roll on the surfaces of the toner particles, charge is efficiently injected from the photosensitive member to the toner, resulting in uniform chargeability of the toner. In addition, when the process speed is increased, the toner particles become less liable to be embedded even at the time of output of a durable image. Because of this, the charge injection property from the photosensitive member to the toner becomes satisfactory over a long period of time from the initial stage. As a result, an image defect (coarseness in a halftone image) caused by toner scattering can be suppressed over a long period of time from the initial stage. Further, the deterioration of the toner is stably suppressed until the end of the life of the cartridge. As a result, stable fluidity can be maintained from the initial stage to the end of the life of the cartridge. Accordingly, fogging under a high-temperature and high-humidity environment becomes satisfactory from the initial stage to the end of the life of the cartridge.

Further, in $^{13}$C-NMR measurement of the organosilicon polymer particle, a rete of a content of a silanol structure to sum of a content of an alkoxysilane structure in the T1 unit structure and the T2 unit structure and a content of a silanol structure included in the T1 unit structure and the T2 unit structure is preferably 98 mass % or more. When the rate is 98 mass % or more, the charge injection property to the toner, which is the effect of the present invention, becomes further satisfactory.

The case of using the provision (ii) a toner including a toner particle that contains the binder resin and includes an organosilicon polymer on a surface thereof is described.

In the above-mentioned configuration, when the toner including the toner particle that includes the organosilicon polymer on the surface is used, the formation method thereof is not particularly limited, and conventionally known methods may be used. Of those, for the reason that the organosilicon polymer can be easily formed on the surface of each of toner base particles, there can be used a method involving condensing the compound described in the description of the organosilicon compound represented by the formula (Z) in an aqueous medium in which toner base particles are dispersed, to thereby form an organosilicon polymer on each of the toner base particles.

The above-mentioned method is described below.

When toner particles each including the organosilicon polymer on the surface are formed, it is preferred that the formation include: a step (step 1) of dispersing toner base particles in an aqueous medium to provide a toner base particle-dispersed liquid; and a step (step 2) of mixing an organosilicon compound (or a hydrolyzate thereof) with the toner base particle-dispersed liquid and subjecting the organosilicon compound to a condensation reaction in the toner base particle-dispersed liquid, to thereby form an organosilicon polymer on each of the toner base particles.

Examples of a method of obtaining the toner base particle-dispersed liquid in the step 1 include: a method including using the dispersion liquid of the toner base particles produced in the aqueous medium as it is; and a method including loading dry toner base particles into the aqueous medium and mechanically dispersing the toner base particles therein. When the dry toner base particles are dispersed in the aqueous medium, a dispersion aid may be used.

As the dispersion aid, for example, a known dispersion stabilizer or surfactant may be used. Specific examples of the dispersion stabilizer include the following: inorganic dispersion stabilizers, such as tricalcium phosphate, hydroxyapatite, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina; and organic dispersion stabilizers, such as polyvinyl alcohol, gelatin, methyl cellulose, methylhydroxypropyl cellulose, ethyl cellulose, a sodium salt of carboxymethyl cellulose, and starch. In addition, examples of the surfactant include the following: anionic surfactants, such as an alkylsulfuric acid ester salt, an alkylbenzenesulfonic acid salt, and a fatty acid salt; nonionic surfactants, such as a polyoxyethylene alkyl ether and a polyoxypropylene alkyl ether; and cationic surfactants, such as an alkylamine salt and a quaternary ammonium salt. Of those, an inorganic dispersion stabilizer is preferably included, and a dispersion stabilizer containing a phosphoric acid salt, such as tricalcium phosphate, hydroxyapatite, magnesium phosphate, zinc phosphate, or aluminum phosphate, is more preferably included.

In the step 2, the organosilicon compound may be added as it is to the toner base particle-dispersed liquid, or may be added to the toner base particle-dispersed liquid after its hydrolysis. Of those methods, the method including adding the compound after its hydrolysis is preferred because the condensation reaction is easily controlled, and hence the amount of the organosilicon compound remaining in the toner base particle-dispersed liquid can be reduced. The hydrolysis is preferably performed in an aqueous medium whose pH has been adjusted with a known acid and a known base. It has been known that the hydrolysis of the organosilicon compound has pH dependence, and the pH when the hydrolysis is performed is preferably changed in accordance with the kind of the organosilicon compound as appropriate. For example, when methyltriethoxysilane is used as the organosilicon compound, the pH of the aqueous medium is preferably 2.0 or more and 6.0 or less.

Specific examples of the acid for adjusting the pH include the following: inorganic acids, such as hydrochloric acid, hydrobromic acid, hydroiodic acid, hypochloric acid, chlorous acid, chloric acid, perchloric acid, hypobromic acid, bromous acid, bromic acid, perbromic acid, hypoiodic acid, iodous acid, iodic acid, periodic acid, sulfuric acid, nitric acid, phosphoric acid, and boric acid; and organic acids, such as acetic acid, citric acid, formic acid, gluconic acid, lactic acid, oxalic acid, and tartaric acid.

Specific examples of the base for adjusting the pH include the following: alkali metal hydroxides, such as potassium hydroxide, sodium hydroxide, and lithium hydroxide, and aqueous solutions thereof; alkali metal carbonic acid salts, such as potassium carbonate, sodium carbonate, and lithium carbonate, and aqueous solutions thereof; alkali metal sulfuric acid salts, such as potassium sulfate, sodium sulfate, and lithium sulfate, and aqueous solutions thereof; alkali metal phosphoric acid salts, such as potassium phosphate, sodium phosphate, and lithium phosphate, and aqueous solutions thereof; alkaline earth metal hydroxides, such as calcium hydroxide and magnesium hydroxide, and aqueous solutions thereof; ammonia; and amines, such as triethylamine.

The condensation reaction in the step 2 is preferably controlled by adjusting the pH of the toner base particle-dispersed liquid. It has been known that the condensation reaction of the organosilicon compound has pH dependence, and the pH when the condensation reaction is performed is preferably changed in accordance with the kind of the organosilicon compound as appropriate. For example, when methyltriethoxysilane is used as the organosilicon compound, the pH of the aqueous medium is preferably 6.0 or more and 12.0 or less. The acids and the bases listed in the section of the hydrolysis may each be used as an acid and a base for adjusting the pH.

In the $^{29}$Si-NMR measurement of the organosilicon polymer, the ratio of the total area of the area of the peak derived from the silicon atom having the T2 unit structure and the area of the peak derived from the silicon atom having the T1 unit structure with respect to the total area of the peaks derived from all the silicon atoms can be controlled to 0.10 or more and 0.40 or less by adjusting the above-mentioned pH, reaction temperature, and reaction time.

In the case where the ratio of the total area of the area of the peak derived from the silicon atom having the T2 unit structure and the area of the peak derived from the silicon atom having the T1 unit structure with respect to the total area of the peaks derived from all the silicon atoms is less than 0.10, when charge is injected from the photosensitive member according to the present invention into the toner, the amount of silanol groups (and alkoxysilane groups in part thereof) of the organosilicon polymer is small, with the result that the charge injection property is lowered. As a result, an image defect (coarseness in a halftone image) caused by toner scattering becomes liable to occur due to the charging failure at the time of development that occurs when the process speed is increased. In addition, fogging caused by electrostatic aggregation under a low-temperature and low-humidity environment deteriorates.

Meanwhile, in the case where the ratio of the total area is more than 0.40, when charge is injected from the photosensitive member according to the present invention into the toner, the amount of silanol groups (and alkoxysilane groups in a part thereof) of the organosilicon polymer is large, and charge leakage becomes liable to occur due to the organosilicon polymer, with the result that the charge injection property from the photosensitive member to the toner is lowered. As a result, an image defect (coarseness in a halftone image) caused by toner scattering becomes liable to occur due to the charging failure at the time of development that occurs when the process speed is increased. In addition, fogging under a high-temperature and high-humidity environment deteriorates.

In the $^{29}$Si-NMR measurement of the organosilicon polymer, a ratio of an area of a peak derived from the silicon atom having the T3 unit structure with respect to a total area of peaks derived from all the silicon atoms contained in the organosilicon polymer is preferably 0.50 or more and 0.90 or less. When the ratio falls within the above-mentioned range, the deterioration of the organosilicon polymer itself is suppressed. As a result, when the process speed is increased, the toner particles become less liable to be embedded even at the time of output of a durable image. Accordingly, the charge injection property from the photosensitive member to the toner becomes satisfactory over a long period of time from the initial stage.

Further, in $^{13}$C-NMR measurement of the organosilicon polymer, a rete of a content of a silanol structure to sum of a content of an alkoxysilane structure in the T1 unit structure and the T2 unit structure and a content of a silanol structure included in the T1 unit structure and the T2 unit structure is preferably 98 mass % or more. When the rate is 98 mass % or more, the charge injection property to the toner, which is the effect of the present invention, becomes further satisfactory.

The average circularity of the toner is preferably 0.950 or more and 0.990 or less, more preferably 0.970 or more and 0.990 or less.

The case in which the average circularity of the toner falls within the above-mentioned ranges means that the shape of the toner is uniform.

Because of this, even when the process speed is increased, transferability becomes satisfactory along with the suppression of an image defect (coarseness in a halftone image) caused by toner scattering, which is the effect of the present invention.

The average circularity of the toner may be controlled by adjusting the production conditions. The average circularity of the toner may be measured by a measurement method described later.

The configuration of the electrophotographic photosensitive member according to the present invention is described below. In FIG. 1, there is illustrated an electrophotographic photosensitive member including an electroconductive support 21, an undercoat layer 22, a charge-generating layer 23, a charge-transporting layer 24, and a surface protective layer 25.

<Support>

In the electrophotographic photosensitive member according to the present invention, the support is preferably an electroconductive support having conductivity. In addition, examples of the shape of the support include a cylindrical shape, a belt shape, and a sheet shape. Of those, a cylindrical support is preferred. In addition, the surface of the support may be subjected to, for example, electrochemical treatment such as anodization, blast treatment, or cutting treatment. A metal, a resin, glass, or the like is preferred as a material for the support. Examples of the metal include aluminum, iron, nickel, copper, gold, stainless steel, and alloys thereof. Of those, an aluminum support using aluminum is preferred. In addition, conductivity is preferably imparted to the resin or the glass through treatment involving, for example, mixing or coating the resin or the glass with a conductive material.

<Conductive Layer>

In the electrophotographic photosensitive member according to the present invention, a conductive layer may be arranged on the support. The arrangement of the conductive layer can conceal flaws and unevenness in the surface of the support, and control the reflection of light on the surface of the support. The conductive layer preferably contains an electroconductive particle and a resin. A material for the electroconductive particle is, for example, a metal oxide, a metal, or carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver. Of those, the metal oxide is preferably used as the electroconductive particle, and in particular, titanium oxide, tin oxide, and zinc oxide are more preferably used.

When the metal oxide is used as the electroconductive particle, the surface of the metal oxide may be treated with a silane coupling agent or the like, or the metal oxide may be doped with an element, such as phosphorus or aluminum, or an oxide thereof.

In addition, the electroconductive particle is a preferably particle each having a niobium atom localized in the vicinity of the surface of a titanium oxide particle, a barium sulfate particle, or a zinc oxide particle.

When the metal oxide is used as the electroconductive particle, their volume-average particle diameter is preferably 1 nm or more and 500 nm or less, more preferably 3 nm or more and 400 nm or less.

Examples of the resin include a polyester resin, a polycarbonate resin, a polyvinyl acetal resin, an acrylic resin, a silicone resin, an epoxy resin, a melamine resin, a polyurethane resin, a phenol resin, and an alkyd resin. In addition, the conductive layer may further contain a concealing agent, such as a silicone oil, resin particles, or titanium oxide.

The conductive layer may be formed by preparing a coating liquid for a conductive layer containing the above-mentioned materials and a solvent, forming a coating film thereof on the support, and drying the coating film. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent. A dispersion method for dispersing the electroconductive particle in the coating liquid for a conductive layer is, for example, a method involving using a paint shaker, a sand mill, a ball mill, or a liquid collision-type high-speed disperser.

The conductive layer has an average thickness of preferably 1 μm or more and 40 μm or less, particularly preferably 3 μm or more and 30 μm or less.

<Undercoat Layer>

In the electrophotographic photosensitive member according to the present invention, an undercoat layer may be arranged on the support or the conductive layer.

The arrangement of the undercoat layer can improve an adhesive function between layers to impart a charge injection-inhibiting function. The undercoat layer preferably contains a resin. In addition, the undercoat layer may be formed as a cured film by polymerizing a composition containing a monomer having a polymerizable functional group.

Examples of the resin include a polyester resin, a polycarbonate resin, a polyvinyl acetal resin, an acrylic resin, an epoxy resin, a melamine resin, a polyurethane resin, a phenol resin, a polyvinyl phenol resin, an alkyd resin, a polyvinyl alcohol resin, a polyethylene oxide resin, a polypropylene oxide resin, a polyamide resin, a polyamic acid resin, a polyimide resin, a polyamide imide resin, and a cellulose resin.

Examples of the polymerizable functional group of the monomer having a polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, and a carbon-carbon double bond group.

In addition, the undercoat layer may further contain an electron-transporting substance, a metal oxide, a metal, a conductive polymer, and the like for the purpose of improving electric characteristics. Of those, an electron-transporting substance and a metal oxide are preferably used.

Examples of the electron-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. An electron-transporting substance having a polymerizable functional group may be used as the electron-transporting substance and copolymerized with the above-mentioned monomer having a polymerizable functional group to form the undercoat layer as a cured film.

Examples of the metal oxide include indium tin oxide, tin oxide, indium oxide, titanium oxide, zinc oxide, aluminum oxide, and silicon dioxide. Examples of the metal include gold, silver, and aluminum.

The metal oxide particles to be incorporated into the undercoat layer may be subjected to surface treatment with a surface treatment agent such as a silane coupling agent before use.

A general method is used as a method of subjecting the metal oxide particles to the surface treatment. Examples thereof include a dry method and a wet method.

The dry method involves, while stirring the metal oxide particles in a mixer capable of high-speed stirring such as a Henschel mixer, adding an alcoholic aqueous solution, organic solvent solution, or aqueous solution containing the surface treatment agent, uniformly dispersing the mixture, and then drying the dispersion.

In addition, the wet method involves stirring the metal oxide particles and the surface treatment agent in a solvent, or dispersing the metal oxide particles and the surface treatment agent in a solvent with a sand mill or the like using glass beads or the like. After the dispersion, the solvent is removed by filtration or evaporation under reduced pressure.

After the removal of the solvent, it is preferred to further perform baking at 100° C. or more.

The undercoat layer may further contain an additive, and may contain a known material, for example: powder of a metal such as aluminum; a conductive substance such as carbon black; a charge-transporting substance; a metal chelate compound; or an organometallic compound.

Examples of the charge-transporting substance include a quinone compound, an imide compound, a benzimidazole compound, a cyclopentadienylidene compound, a fluorenone compound, a xanthone compound, a benzophenone compound, a cyanovinyl compound, a halogenated aryl compound, a silole compound, and a boron-containing compound. A charge-transporting substance having a polymerizable functional group may be used as the charge-transporting substance and copolymerized with the above-mentioned monomer having a polymerizable functional group to form the undercoat layer as a cured film.

The undercoat layer may be formed by preparing a coating liquid for an undercoat layer containing the above-mentioned materials and a solvent, forming a coating film thereof on the support or the conductive layer, and drying and/or curing the coating film.

Examples of the solvent to be used for the coating liquid for an undercoat layer include organic solvents, such as an alcohol, a sulfoxide, a ketone, an ether, an ester, an aliphatic halogenated hydrocarbon, and an aromatic compound. In the present invention, alcohol-based and ketone-based solvents are preferably used.

A dispersion method for preparing the coating liquid for an undercoat layer is, for example, a method involving using a homogenizer, an ultrasonic disperser, a ball mill, a sand mill, a roll mill, a vibration mill, an attritor, or a liquid collision-type high-speed disperser.

The undercoat layer has an average thickness of preferably 0.1 μm or more and 10 μm or less, more preferably 0.1 μm or more and 5 μm or less.

<Photosensitive Layer>

The photosensitive layers of the electrophotographic photosensitive member are mainly classified into (1) a laminate-type photosensitive layer and (2) a monolayer-type photosensitive layer. (1) The laminate-type photosensitive layer is a photosensitive layer having a charge-generating layer containing a charge-generating substance and a charge-transporting layer containing a charge-transporting substance. (2) The monolayer-type photosensitive layer is a photosensitive layer containing both a charge-generating substance and a charge-transporting substance.

(1) Laminate-Type Photosensitive Layer

The laminate-type photosensitive layer has the charge-generating layer and the charge-transporting layer.

(1-1) Charge-Generating Layer

The charge-generating layer preferably contains the charge-generating substance and a resin.

Examples of the charge-generating substance include azo pigments, perylene pigments, polycyclic quinone pigments, indigo pigments, and phthalocyanine pigments. Of those, azo pigments and phthalocyanine pigments are preferred. Of the phthalocyanine pigments, an oxytitanium phthalocyanine pigment, a chlorogallium phthalocyanine pigment, and a hydroxygallium phthalocyanine pigment are preferred.

The content of the charge-generating substance in the charge-generating layer is preferably 40 mass % or more and 85 mass % or less, more preferably 60 mass % or more and 80 mass % or less with respect to the total mass of the charge-generating layer.

Examples of the resin include a polyester resin, a polycarbonate resin, a polyvinyl acetal resin, a polyvinyl butyral resin, an acrylic resin, a silicone resin, an epoxy resin, a melamine resin, a polyurethane resin, a phenol resin, a polyvinyl alcohol resin, a cellulose resin, a polystyrene resin, a polyvinyl acetate resin, and a polyvinyl chloride resin. Of those, a polyvinyl butyral resin is more preferred.

In addition, the charge-generating layer may further contain an additive, such as an antioxidant or a UV absorber. Specific examples thereof include a hindered phenol compound, a hindered amine compound, a sulfur compound, a phosphorus compound, and a benzophenone compound.

The charge-generating layer may be formed by preparing a coating liquid for a charge-generating layer containing the above-mentioned materials and a solvent, forming a coating film thereof on the undercoat layer, and drying the coating film. Examples of the solvent to be used for the coating liquid include an alcohol-based solvent, a sulfoxide-based solvent, a ketone-based solvent, an ether-based solvent, an ester-based solvent, and an aromatic hydrocarbon-based solvent.

The charge-generating layer has an average thickness of preferably 0.1 μm or more and 1 μm or less, more preferably 0.15 μm or more and 0.4 μm or less.

(1-2) Charge-Transporting Layer

The charge-transporting layer preferably contains the charge-transporting substance and a resin.

Examples of the charge-transporting substance include a polycyclic aromatic compound, a heterocyclic compound, a hydrazone compound, a styryl compound, an enamine compound, a benzidine compound, a triarylamine compound, and a resin having a group derived from each of those substances. Of those, a triarylamine compound and a benzidine compound are preferred.

The content of the charge-transporting substance in the charge-transporting layer is preferably 25 mass % or more and 70 mass % or less, more preferably 30 mass % or more and 55 mass % or less with respect to the total mass of the charge-transporting layer.

Examples of the resin include a polyester resin, a polycarbonate resin, an acrylic resin, and a polystyrene resin. Of those, a polycarbonate resin and a polyester resin are preferred. A polyarylate resin is particularly preferred as the polyester resin.

A content ratio (mass ratio) between the charge-transporting substance and the resin is preferably from 4:10 to 20:10, more preferably from 5:10 to 12:10.

In addition, the charge-transporting layer may contain an additive, such as an antioxidant, a UV absorber, a plasticizer, a leveling agent, a slipperiness-imparting agent, or a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The charge-transporting layer may be formed by preparing a coating liquid for a charge-transporting layer containing the above-mentioned materials and a solvent, forming a coating film thereof on the charge-generating layer, and drying the coating film. Examples of the solvent to be used for the coating liquid include an alcohol-based solvent, a ketone-based solvent, an ether-based solvent, an ester-based solvent, and an aromatic hydrocarbon-based solvent. Of those solvents, an ether-based solvent or an aromatic hydrocarbon-based solvent is preferred.

The charge-transporting layer has an average thickness of 3 μm or more and 50 μm or less, more preferably 5 μm or more and 40 μm or less, particularly preferably 10 μm or more and 30 μm or less.

(2) Monolayer-Type Photosensitive Layer

The monolayer-type photosensitive layer may be formed by preparing a coating liquid for a photosensitive layer containing a charge-generating substance, a charge-transporting substance, a resin, and a solvent, forming a coating film thereof on the undercoat layer, and drying the coating film. Examples of the charge-generating substance, the charge-transporting substance, and the resin are the same as those of the materials in the section "(1) Laminate-type Photosensitive Layer".

<Surface Protective Layer>

The surface protective layer may contain a polymerized product of a compound having a polymerizable functional group and a resin.

Examples of the polymerizable functional group include an isocyanate group, a blocked isocyanate group, a methylol group, an alkylated methylol group, an epoxy group, a metal alkoxide group, a hydroxyl group, an amino group, a carboxyl group, a thiol group, a carboxylic acid anhydride group, a carbon-carbon double bond group, an alkoxysilyl group, and a silanol group. A monomer having a charge-transporting ability may be used as the compound having a polymerizable functional group.

Examples of the resin include a polyester resin, an acrylic resin, a phenoxy resin, a polycarbonate resin, a polystyrene resin, a phenol resin, a melamine resin, and an epoxy resin. Of those, an acrylic resin is preferred.

The material and particle diameter of the electroconductive particle contained in the surface protective layer are as described above. In addition, from the viewpoints of dispersibility and liquid stability, the surface of a metal oxide is preferably treated with a silane coupling agent or the like.

The surface protective layer may contain additives, such as an antioxidant, a UV absorber, a plasticizer, a leveling agent, a slipperiness-imparting agent, and a wear resistance-improving agent. Specific examples thereof include a hindered phenol compound, a hindered amine compound, a sulfur compound, a phosphorus compound, a benzophenone compound, a siloxane-modified resin, a silicone oil, fluorine resin particles, polystyrene resin particles, polyethylene resin particles, silica particles, alumina particles, and boron nitride particles.

The surface protective layer may be formed by preparing a coating liquid for a surface protective layer containing the above-mentioned materials and a solvent, forming a coating film thereof on the photosensitive layer, and drying and/or curing the coating film. Examples of the solvent to be used for the coating liquid include an alcohol-based solvent, a ketone-based solvent, an ether-based solvent, a sulfoxide-based solvent, an ester-based solvent, and an aromatic hydrocarbon-based solvent.

The surface protective layer has an average thickness of preferably 0.2 μm or more and 5 μm or less, more preferably 0.5 μm or more and 3 μm or less.

The configuration of the toner according to the present invention is described below.

<Binder Resin>

The toner according to the present invention contains a binder resin. The content of the binder resin is preferably 50 mass % or more with respect to the total amount of the resin component in the toner particles.

The binder resin is not particularly limited, and examples thereof include a styrene-acrylic resin, an epoxy resin, a polyester resin, a polyurethane resin, a polyamide resin, a cellulose resin, a polyether resin, and mixed resins or composited resins thereof. Of those, a styrene-acrylic resin and a polyester resin are preferred from the viewpoints of low cost, easy availability, and excellent low-temperature fixability. Further, a styrene-acrylic resin is more preferred from the viewpoint of excellent development durability.

The polyester resin is obtained by selecting suitable materials from a polyvalent carboxylic acid, a polyol, a hydroxycarboxylic acid, and the like, combining the selected materials, and synthesizing the resin therefrom by a conventionally known method, such as a transesterification method or a polycondensation method.

The polyvalent carboxylic acid is a compound containing two or more carboxy groups in one molecule. Of those, a dicarboxylic acid, which is a compound containing two carboxy groups in one molecule, is preferably used.

Examples thereof may include oxalic acid, succinic acid, glutaric acid, maleic acid, adipic acid, β-methyladipic acid, azelaic acid, sebacic acid, nonanedicarboxylic acid, decanedicarboxylic acid, undecanedicarboxylic acid, dodecanedicarboxylic acid, fumaric acid, citraconic acid, diglycolic acid, cyclohexane-3,5-diene-1,2-carboxylic acid, hexahydroterephthalic acid, malonic acid, pimelic acid, suberic acid, phthalic acid, isophthalic acid, terephthalic acid, tetrachlorophthalic acid, chlorophthalic acid, nitrophthalic acid, p-carboxyphenylacetic acid, p-phenylenediacetic acid, m-phenylenediacetic acid, o-phenylenediacetic acid, diphenylacetic acid, diphenyl-p,p'-dicarboxylic acid, naphthalene-1,4-dicarboxylic acid, naphthalene-1,5-dicarboxylic acid, naphthalene-2,6-dicarboxylic acid, anthracenedicarboxylic acid, and cyclohexanedicarboxylic acid.

In addition, examples of the polyvalent carboxylic acid other than the dicarboxylic acid include trimellitic acid, trimesic acid, pyromellitic acid, naphthalenetricarboxylic acid, naphthalenetetracarboxylic acid, pyrenetricarboxylic acid, pyrenetetracarboxylic acid, itaconic acid, glutaconic acid, n-dodecylsuccinic acid, n-dodecenyl succinic acid, isododecylsuccinic acid, isododecenylsuccinic acid, n-octylsuccinic acid, and n-octenylsuccinic acid. Those carboxylic acids may be used alone or in combination thereof.

The polyol is a compound containing two or more hydroxy groups in one molecule. Of those, a diol, which is a compound containing two hydroxy groups in one molecule, is preferably used.

Specific examples thereof include ethylene glycol, diethylene glycol, triethylene glycol, 1,2-propylene glycol, 1,3-propylene glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, dipropylene glycol, polyethylene glycol, polypropylene glycol, polytetramethylene ether glycol, 1,4-cyclohexanediol, 1,4-cyclohexanedimethanol, 1,4-butenediol, neopentyl glycol, polytetramethylene glycol, hydrogenated bisphenol A, bisphenol A, bisphenol F, bisphenol S, and alkylene oxide (e.g., ethylene oxide, propylene oxide, and butylene oxide) adducts of the above-mentioned bisphenols. Of those, an alkylene glycol having 2 to 12 carbon atoms and an alkylene oxide adduct of a bisphenol are preferred, and combined use of the alkylene oxide adduct of a bisphenol with the alkylene glycol having 2 to 12 carbon atoms is particularly preferred.

A trihydric or higher alcohol is, for example, glycerin, trimethylolethane, trimethylolpropane, pentaerythritol, hexamethylol melamine, hexaethylol melamine, tetramethylol benzoguanamine, tetraethylol benzoguanamine, sorbitol, trisphenol PA, phenol novolac, cresol novolac, and alkylene oxide adducts of the above-mentioned trihydric or higher alcohols. Those alcohols may be used alone or in combination thereof.

Examples of the styrene-acrylic resin include homopolymers each formed of any one of the following polymerizable monomers, or copolymers each obtained by combining two or more kinds thereof, and mixtures thereof: styrene and styrene derivatives, such as α-methylstyrene, β-methylstyrene, o-methylstyrene, m-methylstyrene, p-methylstyrene, 2,4-dimethylstyrene, p-n-butyl styrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene;

(meth)acrylic derivatives, such as methyl (meth)acrylate, ethyl (meth)acrylate, n-propyl (meth)acrylate, iso-propyl (meth)acrylate, n-butyl (meth)acrylate, iso-butyl (meth) acrylate, tert-butyl (meth)acrylate, n-amyl (meth)acrylate, n-hexyl (meth)acrylate, 2-ethylhexyl (meth)acrylate, n-octyl (meth)acrylate, n-nonyl (meth)acrylate, cyclohexyl (meth) acrylate, benzyl (meth)acrylate, dimethyl phosphate ethyl (meth)acrylate, diethyl phosphate ethyl (meth)acrylate, dibutyl phosphate ethyl (meth)acrylate, 2-benzoyloxyethyl (meth)acrylate, (meth)acrylonitrile, 2-hydroxyethyl (meth) acrylate, (meth)acrylic acid, and maleic acid; and vinyl ether derivatives, such as vinyl methyl ether and vinyl isobutyl ether; vinyl ketone derivatives, such as vinyl methyl ketone, vinyl ethyl ketone, and vinyl isopropenyl ketone; and polyolefins, such as ethylene, propylene, and butadiene.

A polyfunctional polymerizable monomer may be used as the styrene-acrylic resin as required. Examples of the polyfunctional polymerizable monomer include diethylene glycol di(meth)acrylate, triethylene glycol di(meth)acrylate, tetraethylene glycol di(meth)acrylate, polyethylene glycol di(meth)acrylate, 1,6-hexanediol di(meth)acrylate, neopentyl glycol di(meth)acrylate, tripropylene glycol di(meth) acrylate, polypropylene glycol di(meth)acrylate, 2,2'-bis(4-((meth)acryloxydiethoxy)phenyl)propane, trimethylolpropane tri(meth)acrylate, tetramethylolmethane tetra(meth)acrylate, divinylbenzene, divinylnaphthalene, and divinyl ether.

In addition, in order to control a polymerization degree, a known chain transfer agent and polymerization inhibitor may be further added.

Examples of the polymerization initiator for obtaining the styrene-acrylic resin include an organic peroxide-based initiator and an azo-based polymerization initiator.

Examples of the organic peroxide-based initiator include benzoyl peroxide, lauroyl peroxide, di-α-cumyl peroxide, 2,5-dimethyl-2,5-bis(benzoylperoxy)hexane, bis(4-t-butylcyclohexyl) peroxydicarbonate, 1,1-bis(t-butylperoxy)cyclododecane, t-butyl peroxymaleate, bis(t-butylperoxy) isophthalate, methyl ethyl ketone peroxide, tert-butyl peroxy-2-ethylhexanoate, diisopropyl peroxycarbonate, cumene hydroperoxide, 2,4-dichlorobenzoyl peroxide, and tert-butyl-peroxypivalate.

Examples of the azo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobismethylbutyronitrile, and 2,2'-azobis-(methyl isobutyrate).

In addition, a redox-based initiator obtained by combining an oxidizing substance and a reducing substance may also be used as the polymerization initiator. Examples of the oxidizing substance include inorganic peroxides, such as hydrogen peroxide and persulfuric acid salts (sodium salt, potassium salt, and ammonium salt), and oxidizing metal salts such as a tetravalent cerium salt. Examples of the reducing substance include: reducing metal salts (divalent iron salt, monovalent copper salt, and trivalent chromium salt); ammonia; amino compounds, such as lower amines (amines each having about 1 or more and 6 or less carbon atoms, such as methylamine and ethylamine) and hydroxylamine; reducing sulfur compounds, such as sodium thiosulfate, sodium hydrosulfite, sodium bisulfite, sodium sulfite, and sodium formaldehyde sulfoxylate; lower alcohols (each having 1 or more and 6 or less carbon atoms); ascorbic acid or salts thereof; and lower aldehydes (each having 1 or more and 6 or less carbon atoms).

The polymerization initiators are selected with reference to their 10-hour half-life temperatures, and are utilized alone or as a mixture thereof. The addition amount of the polymerization initiator varies depending on the target polymerization degree, but in general, 0.5 part by mass or more and 20.0 parts by mass or less thereof is added with respect to 100.0 parts by mass of the polymerizable monomer.

<Colorant>

The toner according to the present invention may contain a colorant. The colorant is not particularly limited, and conventionally known pigments and dyes of each color of black, yellow, magenta, and cyan, and other colors, a magnetic material, and the like may be used.

An example of the black colorant is a black pigment such as carbon black.

Examples of the yellow colorant include yellow pigments and yellow dyes, such as a monoazo compound, a disazo compound, a condensed azo compound, an isoindolinone compound, a benzimidazolone compound, an anthraquinone compound, an azo metal complex, a methine compound, and an arylamide compound. Specific examples thereof include: C.I. Pigment Yellow 74, 93, 95, 109, 111, 128, 155, 174, 180, or 185; and C.I. Solvent Yellow 162.

Examples of the magenta colorant include magenta pigments and magenta dyes, such as a monoazo compound, a condensed azo compound, a diketopyrrolopyrrole compound, an anthraquinone compound, a quinacridone compound, a basic dye lake compound, a naphthol compound, a benzimidazolone compound, a thioindigo compound, and a perylene compound.

Specific examples thereof include: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269; and C.I. Pigment Violet 19.

Examples of the cyan colorant include cyan pigments and cyan dyes, such as a copper phthalocyanine compound and a derivative thereof, an anthraquinone compound, and a basic dye lake compound.

A specific example thereof is C.I. Pigment Blue 1, 7, 15, 15:1, 15:2, 15:3, 15:4, 60, 62, or 66.

The content of the colorant is preferably 1.0 part by mass or more and 20.0 parts by mass or less with respect to 100.0 parts by mass of the binder resin or the polymerizable monomer.

In addition, a magnetic material may be incorporated into the toner to turn the toner into a magnetic toner. In this case, the magnetic material may also serve as a colorant.

Examples of the magnetic material include: an iron oxide typified by magnetite, hematite, or ferrite; a metal typified by iron, cobalt, or nickel, or an alloy formed of any such metal and a metal, such as aluminum, cobalt, copper, lead, magnesium, tin, zinc, antimony, beryllium, bismuth, cadmium, calcium, manganese, selenium, titanium, tungsten, or vanadium; and mixtures thereof.

<Wax>

A known wax may be used for the toner according to the present invention.

Specific examples thereof include: petroleum-based waxes typified by a paraffin wax, a microcrystalline wax, and petrolatum, and derivatives thereof; a Montan wax and derivatives thereof; a hydrocarbon wax produced by a Fischer-Tropsch process and derivatives thereof; polyolefin waxes typified by polyethylene, and derivatives thereof; and natural waxes typified by a carnauba wax and a candelilla wax, and derivatives thereof. The derivatives include oxides, and block copolymerization products or graft-modified products with vinyl monomers. The examples also include: alcohols such as a higher aliphatic alcohol; fatty acids, such as stearic acid and palmitic acid, and acid amides, esters, and ketones thereof; a hydrogenated castor oil and derivatives thereof; plant waxes; and animal waxes. Those waxes may be used alone or in combination thereof.

The content of those waxes is preferably 1.0 part by mass or more and 30.0 parts by mass or less with respect to 100.0 parts by mass of the binder resin.

<Charge Control Agent>

The toner according to the present invention may contain a charge control agent. The charge control agent is not particularly limited, and known charge control agents may be used. Specific examples of a negative charge control agent include the following: a metal compound of an aromatic carboxylic acid, such as salicylic acid, an alkyl salicylic acid, a dialkyl salicylic acid, naphthoic acid, or a dicarboxylic acid, or a polymer or a copolymer having the metal compound of the aromatic carboxylic acid; a polymer or a copolymer having a sulfonic acid group, a sulfonic acid salt group, or a sulfonic acid ester group; a metal salt or a metal complex of an azo dye or an azo pigment; a boron compound; a silicon compound; and a calixarene.

Meanwhile, examples of a positive charge control agent include the following: a quaternary ammonium salt; a polymer-type compound having a quaternary ammonium salt in a side chain; a guanidine compound; a nigrosine-based compound; and an imidazole compound. As a polymer or a copolymer having a sulfonic acid salt group or a sulfonic acid ester group, a homopolymer of a sulfonic acid group-containing vinyl-based monomer, such as styrenesulfonic acid, 2-acrylamido-2-methylpropanesulfonic acid, 2-methacrylamido-2-methylpropanesulfonic acid, vinylsulfonic acid, or methacrylsulfonic acid, a copolymer of the vinyl-based monomer described in the section of the binder resin and the above-mentioned sulfonic acid group-containing vinyl-based monomer, or the like may be used.

The content of the charge control agent is preferably 0.01 part by mass or more and 5.0 parts by mass or less with respect to 100.0 parts by mass of the binder resin or the polymerizable monomer.

<External Additive>

The toner according to the present invention may contain an external additive.

The external additive is not particularly limited, and conventionally known external additives may be used. Specific examples thereof include the following: base material silica fine particles, such as wet process silica and dry process silica, or surface-treated silica fine particles obtained by subjecting the base material silica fine particles to surface treatment with a treatment agent, such as a silane coupling agent, a titanium coupling agent, or a silicone oil; and resin fine particles, such as vinylidene fluoride fine particles and polytetrafluoroethylene fine particles.

The content of the external additive is preferably 0.1 part by mass or more and 5.0 parts by mass or less with respect to 100.0 parts by mass of the toner particles.

<Production of Toner Base Particles>

A method of producing toner base particles is not particularly limited, and a suspension polymerization method, a dissolution suspension method, an emulsion aggregation method, a pulverization method, or the like may be used. Of those, a suspension polymerization method is preferred.

As an example, a method of obtaining the toner base particles by the suspension polymerization method is described below.

First, a polymerizable monomer capable of producing a binder resin, and as required, various additives are mixed, and the materials are dissolved or dispersed with a dispersing machine to prepare a polymerizable monomer composition.

Examples of the various additives include a colorant, a wax, a charge control agent, a polymerization initiator, and a chain transfer agent.

The dispersing machine is, for example, a homogenizer, a ball mill, a colloid mill, or an ultrasonic dispersing machine.

Next, the polymerizable monomer composition is loaded into an aqueous medium containing poorly water-soluble inorganic fine particles, and the liquid droplets of the polymerizable monomer composition are prepared by using a high-speed dispersing machine, such as a high-speed stirring machine or an ultrasonic dispersing machine (granulation step).

After that, the polymerizable monomer in each of the liquid droplets is polymerized to provide the toner base particles (polymerization step).

The polymerization initiator may be mixed at the time of the preparation of the polymerizable monomer composition, or may be mixed in the polymerizable monomer composition immediately before the formation of the liquid droplets in the aqueous medium. In addition, during the granulation of the liquid droplets or after the completion of the granulation, that is, immediately before the initiation of the polymerization reaction, the initiator may be added under a state of being dissolved in the polymerizable monomer or any other solvent as required.

After the polymerizable monomer has been polymerized to provide a binder resin, desolvation treatment is desirably performed as required to provide the dispersion liquid of the toner base particles.

When the binder resin is obtained by the emulsion aggregation method, the suspension polymerization method, or the like, the polymerizable monomer is not particularly limited, and a conventionally known monomer may be used. A specific example thereof is the vinyl-based monomer described in the section of the binder resin.

The polymerization initiator is not particularly limited, and a known polymerization initiator may be used. Specific examples thereof include those described above.

[Process Cartridge and Electrophotographic Apparatus]

The process cartridge of the present invention is characterized by including the electrophotographic photosensitive member and toner described above and a developing unit that stores the toner and being detachable from the main body of an electrophotographic apparatus.

The developing unit includes a toner storing portion that stores a toner, and supplies the toner to the surface of the electrophotographic photosensitive member. In the present invention, the developing unit is preferably a contact developing device that performs development by bringing a toner carrying member that carries the toner into contact with the photosensitive member. In addition, the electrophotographic apparatus of the present invention is characterized by including the process cartridge of the present invention.

Figure 2:
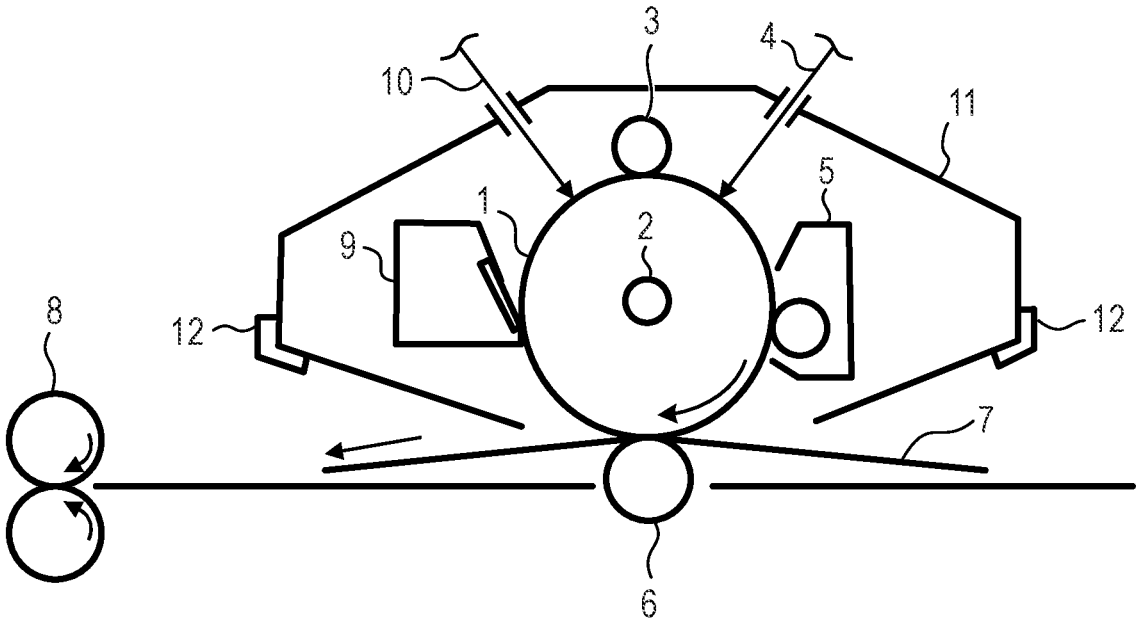
FIG. 2 is a view for illustrating an example of a schematic configuration of each of a process cartridge having the electrophotographic photosensitive member according to the present invention mounted thereon and an electrophotographic apparatus including the process cartridge.

An example of the schematic configuration of an electrophotographic apparatus including a process cartridge including an electrophotographic photosensitive member is illustrated in FIG. 2. An electrophotographic photosensitive member (1 in FIG. 2) of a cylindrical shape (drum shape) is rotationally driven about a shaft 2 in a direction indicated by the arrow at a predetermined peripheral speed (process speed). The surface of the electrophotographic photosensitive member is charged to a predetermined positive or negative potential by a charging unit 3 in the rotational process. In FIG. 2, a roller charging system based on a roller-type charging member is illustrated, but a charging system, such as a corona charging system, a proximity charging system, or an injection charging system, may be adopted. The charged surface of the electrophotographic photosensitive member is irradiated with exposure light 4 from an exposing unit (not shown), and hence an electrostatic latent image corresponding to target image information is formed thereon. The exposure light 4 is light whose intensity has been modulated in correspondence with a time-series electric digital image signal of information on a target image, and is emitted, for example, from an image exposing unit, such as slit exposure or laser beam scanning exposure. Toner stored in a developing unit 5 develops (normal development or reversal development) the electrostatic latent image formed on the surface of the electrophotographic photosensitive member to form a toner image on the surface of the electrophotographic photosensitive member 1. The toner image formed on the surface of the electrophotographic photosensitive member is transferred by a transferring unit 6 onto a transfer material 7. At this time, a bias voltage opposite in polarity to charge that the toner possesses is applied from a bias power source (not shown) to the transferring unit 6. In addition, when the transfer material 7 is paper, the transfer material 7 is taken out of a sheet feeding portion (not shown) and supplied to a space between the electrophotographic photosensitive member and the transferring unit 6 in synchronization with the rotation of the electrophotographic photosensitive member 1. The transfer material 7 onto which the toner image has been transferred from the electrophotographic photosensitive member is separated from the surface of the electrophotographic photosensitive member, is conveyed to a fixing unit 8, and is subjected to treatment for fixing the toner image to be printed out as an image-formed product (a print or a copy) to the outside of the electrophotographic apparatus. The electrophotographic apparatus may include a cleaning unit 9 for removing a deposit such as the toner remaining on the surface of the electrophotographic photosensitive member after the transfer. In addition, a so-called cleaner-less system configured to remove the deposit with the developing unit 5 or the like without separate arrangement of a cleaning unit may be used. In the present invention, a plurality of components selected from the electrophotographic photosensitive member, the charging unit 3, the developing unit 5, the cleaning unit 9, and the like may be stored in a container and integrally supported to form a process cartridge, and the process cartridge may be detachable from the main body of the electrophotographic apparatus. For example, the process cartridge is configured as described below. At least one selected from the charging unit 3, the developing unit 5, and the cleaning unit 9 is integrally supported with the electrophotographic photosensitive member to form a cartridge. The cartridge may be used as a process cartridge 11 to be detachable from the main body of the electrophotographic apparatus through use of a guiding unit 12 such as a rail of the main body of the electrophotographic apparatus. The electrophotographic apparatus may include an electricity-removing mechanism configured to subject the surface of the electrophotographic photosensitive member to electricity-removing treatment with pre-exposure light 10 from a pre-exposing unit (not shown). In addition, the guiding unit 12 such as the rail may be arranged in order to be detachable the process cartridge 11 of the present invention from the main body of the electrophotographic apparatus. The electrophotographic apparatus of the present invention is characterized by including the above-mentioned process cartridge.

The process cartridge of the present invention can be used in, for example, a laser beam printer, an LED printer, a copying machine, a facsimile, and a multifunctional peripheral thereof.

EXAMPLES

The present invention is more specifically described below by way of Examples and Comparative Examples. However, the present invention is by no means limited to the following Examples, and various modifications may be made without departing from the gist of the present invention. In the following description of Examples, the term "part(s)" is on a mass basis unless otherwise stated.

The present invention is more specifically described below by way of Examples. The term "part(s)" in Examples means "part(s) by mass". A method of measuring each of physical property values is described below.

<Calculation of Primary Particle Diameter of Electroconductive Particle>

First, the electrophotographic photosensitive member was entirely immersed in methyl ethyl ketone (MEK) in a graduated cylinder and irradiated with an ultrasonic wave to peel off resin layers, and then the substrate of the electrophotographic photosensitive member was taken out. Next, insoluble matter that did not dissolve in MEK (the photosensitive layer and the protective layer containing the electroconductive particle) was filtered, and the filtration residue was brought to dryness with a vacuum dryer. Further, the resultant solid was suspended in a mixed solvent of tetrahydrofuran (THF)/methylal at a volume ratio of 1:1, insoluble matter was filtered, and then the filtration residue was recovered and brought to dryness with a vacuum dryer. Through this operation, the electroconductive particle and the resin of the protective layer were obtained. Further, the filtration residue was heated in an electric furnace to 500° C. so as to leave only the electroconductive particle as a solid, and the electroconductive particle was recovered. In order to secure an amount of the electroconductive particle required for measurement, a plurality of electrophotographic photosensitive members were similarly treated.

Part of the recovered electroconductive particle was dispersed in isopropanol (IPA), and the dispersion liquid was dropped onto a grid mesh with a support membrane (manufactured by JEOL Ltd., Cu150J), followed by the observation of the electroconductive particle in the STEM mode of a scanning transmission electron microscope (JEOL Ltd., JEM2800). The observation was performed at a magnification of from 500,000 times to 1,200,000 times so as to facilitate the calculation of the particle diameter of the electroconductive particle, and STEM images of 100 the electroconductive particles were taken. At this time, the following settings were adopted: an acceleration voltage of 200 kV, a probe size of 1 nm, and an image size of 1,024×1,024 pixels. With use of the resultant STEM images, a primary particle diameter was measured with image processing software "Image-Pro Plus (manufactured by Media Cybernetics, Inc.)". First, a scale bar displayed in the lower portion of the STEM image is selected using the straight line tool (Straight Line) of the tool bar. When the Set Scale of the Analyze menu is selected under the state, a new window is opened, and the pixel distance of a selected straight line is input in the "Distance in Pixels" column. The value (e.g., 100) of the scale bar is input in the "Known Distance" column of the window, and the unit (e.g., nm) of the scale bar is input in the "Unit of Measurement" column thereof, followed by the clicking of OK. Thus, scale setting is completed. Next, a straight line was drawn so as to coincide with the maximum diameter of a conductive particle using the straight line tool, and the particle diameter was calculated. The same operation was performed for 100 electroconductive particles, and the number average of the resultant values (maximum diameters) was adopted as the primary particle diameter (hereinafter also referred to as "number-average particle diameter") of the electroconductive particle.

<Calculation of Niobium Atom/Titanium Atom Concentration Ratio>

One 5 mm square sample piece was cut out of the photosensitive member, and was cut to a thickness of 200 nm with an ultrasonic ultramicrotome (Leica, UC7) at a cutting speed of 0.6 mm/s to produce a slice sample. The slice sample was observed at a magnification of from 500,000 times to 1,200,000 times in the STEM mode of a scanning transmission electron microscope (JEOL Ltd., JEM2800) having connected thereto an EDS analyzer (energy-dispersive X-ray spectrometer).

Of the cross-sections of the electroconductive particles observed, cross-sections of the electroconductive particles each having a maximum diameter that was about 0.9 or more times and about 1.1 or less times as large as the primary particle diameter calculated in the foregoing were selected through visual observation. Subsequently, spectra of the constituent elements of the selected cross-sections of the electroconductive particles were collected using the EDS analyzer to produce EDS mapping images. The collection and analysis of the spectra were performed using NSS (Thermo Fisher Scientific). Collection conditions were set to an acceleration voltage of 200 kV, a probe size of 1.0 nm or 1.5 nm appropriately selected so as to achieve a dead time of 15 or more and 30 or less, a mapping resolution of 256×256, and a Frame number of 300. The EDS mapping images were obtained for 100 cross-sections of electroconductive particles.

The thus obtained EDS mapping images are each analyzed to calculate a ratio between a niobium atom concentration (atom %) and a titanium atom concentration (atom %) at each of the central portion of a particle and an inside portion at 5% of the maximum diameter of a measurement particle from the surface of the particle. Specifically, first, the "Line Extraction" button of NSS is pressed to draw a straight line so as to coincide with the maximum diameter of the particle, and information is obtained on an atom concentration (atom %) on the straight line extending from one surface, passing through the inside of the particle, and reaching the other surface. When the maximum diameter of the particle obtained at this time fell within the range of less than 0.9 times or more than 1.1 times the primary particle diameter calculated in the foregoing, the particle was excluded from the subsequent analysis. (Only particles each having a maximum diameter in the range of from 0.9 or more times to less than 1.1 times the primary particle diameter were subjected to the analysis described below.) Next, on the surfaces on both sides of the particle, the niobium atom concentration (atom %) at the inside portion at 5% of the maximum diameter of the measurement particle from the surface of the particle is read. Similarly, the "titanium atom concentration (atom %) at the inside portion at 5% of the maximum diameter of the measurement particle from the surface of the particle" is obtained. Then, with use of those values, the "concentration ratio between the niobium atom and the titanium atom at the inside portion at 5% of the maximum diameter of the measurement particle from the surface of the particle" is obtained from the following expression for each of the surfaces on both sides of the particle.

Concentration ratio between niobium atom and titanium atom at inside portion at 5% of maximum diameter of measurement particle from surface of particle=(niobium atom concentration (atom %) at inside portion at 5% of maximum diameter of measurement particle from surface of particle)/(titanium atom concentration (atom %) at inside portion at 5% of maximum diameter of measurement particle from surface of particle)

Of the two concentration ratios obtained, the one with a smaller value is adopted as the "concentration ratio between the niobium atom and the titanium atom at the inside portion at 5% of the maximum diameter of the measurement particle from the surface of the particle" in the present invention.

In addition, a niobium atom concentration (atom %) and a titanium atom concentration (atom %) at a position located on the above-mentioned straight line and coinciding with the middle point of the maximum diameter are read. With use of those values, the "concentration ratio between the niobium atom and the titanium atom at the central portion of the particle" is obtained from the following expression.

Concentration ratio between niobium atom and titanium atom at central portion of particle=(niobium atom concentration (atom %) at central portion of particle)/(titanium atom concentration (atom %) at central portion of particle)

The "concentration ratio calculated as niobium atom concentration/titanium atom concentration at the inside portion at 5% of the maximum diameter of the measurement particle from the surface of the particle relative to the concentration ratio calculated as niobium atom concentration/titanium atom concentration at the central portion of the particle" is calculated by the following expression.

(Concentration ratio between niobium atom and titanium atom at inside portion at 5% of maximum diameter of measurement particle from surface of particle)/(concentration ratio between niobium atom and titanium atom at central portion of particle)

<Calculation of Content of Electroconductive Particle>

Next, four 5 mm square sample pieces were cut out of the photosensitive member, and the protective layer was reconstructed into a three-dimensional object of 2 μm×2 μm×2 μm with Slice&View of FIB-SEM. Based on a difference in contrast of Slice&View of FIB-SEM, the content of the particles in the total volume of the protective layer was calculated. In Examples, the conditions of Slice&View were as described below.

Processing of sample for analysis: FIB method

Processing and observation apparatus: NVision 40 manufactured by SII/Zeiss

Slice spacing: 10 nm

Observation conditions:
Acceleration voltage: 1.0 kV
Sample tilt: 54°
WD: 5 mm
Detector: BSE detector
Aperture: 60 μm, high current
ABC: ON
Image resolution: 1.25 nm/pixel An analysis region is set to 2 μm long by 2 μm wide, and information for each cross-section is integrated to determine a volume V per 2 μm length×2 μm width×2 μm thickness (8 $\mu m^3$). In addition, a measurement environment has a temperature of 23° C. and a pressure of $1\times10^{-4}$ Pa. Strata 400S manufactured by FEI (sample tilt: 52°) may also be used as a processing and observation apparatus. In addition, the information for each cross-section was obtained through image analysis of the area of an identified electroconductive particle of the present invention. The image analysis was performed using image processing software (manufactured by Media Cybernetics, Image-Pro Plus). Based on the resultant information, the volume V of the electroconductive particle of the present invention in a volume of 2 μm×2 μm×2 μm (unit volume: 8 $\mu m^3$) was determined in each of the four sample pieces. Then, (V $\mu m^3$/8 $\mu m^3$×100) was calculated. The average of the (V $\mu m^3$/8 $\mu m^3$×100) values for the four sample pieces was defined as the content [vol %] of the electroconductive particle of the present invention in the protective layer with respect to the total volume of the protective layer. At this time, all of the four sample pieces were processed to a boundary between the protective layer and the underlying layer to measure a thickness "t" (cm) of the protective layer, and the value was used for the calculation of a volume resistivity ρv in the following section <Method of measuring Volume Resistivity of Protective Layer of Photosensitive Member>.

<Quantification of Niobium Atoms contained in Electroconductive Particle>

The quantification of niobium atoms contained in the electroconductive particle is performed as described below.

The electroconductive particles collected from the photosensitive member in the section <Calculation of Primary Particle Diameter of Electroconductive particle> are pelletized by the following press molding to prepare a sample. Through use of the prepared sample, the measurement is performed with an X-ray fluorescence (XRF) analyzer, and the content of niobium atoms in the entire electroconductive particle is quantified by an FP method.

Specifically, the quantification as niobium pentoxide is performed, followed by conversion into the content of the niobium atoms.

(i) Examples of device to be used: X-ray fluorescence analyzer 3080 (Rigaku Corporation)

(ii) Sample preparation: For sample preparation, a sample press molding machine (manufactured by MAEKAWA Testing Machine MFG. Co., Ltd.) is used. 0.5 g of the electroconductive particles are loaded into an aluminum ring (model number: 3481E1), and the aluminum ring is set to a load of 5.0 tons. The electroconductive particles are pressed for 1 min to be pelletized.

(iii) Measurement Conditions

Measurement diameter: 10φ
Measurement potential and voltage: 50 kV, 50 mA to 70 mA
2θ angle: 25.12°
Crystal plate: LiF
Measurement time: 60 seconds <Powder X-Ray Diffraction Measurement of Electroconductive Particle>

A method of determining whether or not the electroconductive particle used in the electrophotographic photosensitive member of the present invention contain anatase-type titanium oxide or rutile-type titanium oxide is described below.

From a chart obtained from powder X-ray diffraction with CuKα X-rays, identification is performed with the inorganic material database (AtomWork) of National Institute for Materials Science (NIMS). Regarding the electroconductive particle contained in the protective layer of the electrophotographic photosensitive member of the present invention, the treatment described above (quantification of Nb atoms contained in the electroconductive particle) is applied as an example.

Measurement machine used: X-ray diffractometer RINT-TTRII manufactured by Rigaku Corporation
X-ray tube: Cu
Tube voltage: 50 KV
Tube current: 300 mA
Scanning method: 2θ/θ scan
Scanning speed: 4.0°/min
Sampling interval: 0.02°
Start angle (2θ): 5.0°
Stop angle (2θ): 40.0°
Attachment: standard sample holder
Filter: not used
Incident monochromator: used
Counter monochromator: not used
Divergence slit: open
Divergence longitudinal restriction slit: 10.00 mm
Scattering slit: open
Light receiving slit: open
Flat plate monochromator: used
Counter: scintillation counter <Method of Measuring Volume Resistivity of Surface Protective Layer>

Figure 3:
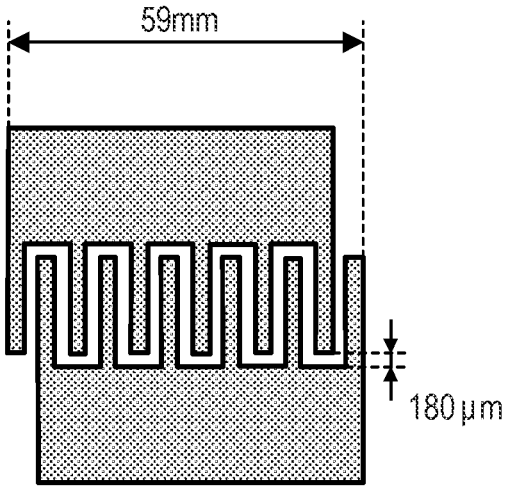
FIG. 3 is a view for illustrating an example of comb-shaped electrodes that measure the volume resistivity of the electrophotographic photosensitive member.

A picoampere meter (pA) was used for measuring the volume resistivity of the present invention. First, comb-shaped gold electrodes as illustrated in FIG. 3 having an electrode-to-electrode distance (D) of 180 μm and a length (L) of 5.9 cm are produced on a PET film by vapor deposition, and a surface protective layer having a thickness (T1) of 2 μm is formed thereon. Next, under an environment having a temperature of 23° C. and a humidity of 50% RH, a DC current (I) at the time of the application of a DC voltage (V) of 100 V between the comb-shaped electrodes was measured, and a volume resistivity (temperature: 23° C./humidity: 50% RH) was obtained by the following expression (7).

$$\text{Volume resistivity } \rho v\ (\Omega\cdot\text{cm}) = V(V)\times T1\ (\text{cm})\times L\ (\text{cm})/\{I(A)\times D\ (\text{cm})\} \quad (7)$$

When the composition, including the electroconductive particles and the binder resin, of the surface protective layer is difficult to identify, the surface resistivity of the surface of the electrophotographic photosensitive member is measured and converted into the volume resistivity. When the volume resistivity of not the surface protective layer alone, but the surface protective layer in a state of coating the surface of the photosensitive member is measured, it is desired that the surface resistivity of the surface protective layer be measured and then converted into the volume resistivity. The surface resistivity ρs may be calculated from the following expression (8) by depositing gold from the vapor to form comb-shaped electrodes on the surface protective layer in a state of coating the photosensitive member, and measuring a DC current at the time of the application of a constant DC voltage.

$$\rho v = \rho s \times t \quad (8)$$

"t" represents the thickness of a charge-injecting layer.

This measurement involves measuring a minute current amount, and hence is preferably performed using, as a resistance-measuring apparatus, an instrument capable of measuring a minute current. An example thereof is a picoammeter 4140B manufactured by Hewlett-Packard Company. The comb-shaped electrodes to be used and the voltage to be applied are each desirably selected in accordance with the material and resistance value of the charge-injecting layer so that an appropriate SN ratio may be obtained.

In the present invention, comb-shaped gold electrodes having an electrode-to-electrode distance (D) of 180 μm and a length (L) of 5.9 cm are produced on the surface of the electrophotographic photosensitive member by vapor deposition. Next, under an environment having a temperature of 23° C. and a humidity of 50% RH, a DC current (I) at the time of the application of a DC voltage (V) of 1,000 V between the comb-shaped electrodes was measured, and a surface resistivity ρs (temperature: 23° C./humidity: 50% RH) was obtained.

Further, the thickness T1 (cm) of the surface protective layer is measured according to the above-mentioned <calculation of content of electroconductive particle>. A volume resistivity ρv (temperature: 23° C./humidity: 50% RH) was obtained by the above-mentioned expression in which the surface resistivity ρs was multiplied by the thickness T1.

<Methods of Measuring Weight-Average Particle Diameter (D4) and Number-average Particle Diameter (D1) of Toner Particles>

The weight-average particle diameter (D4) and number-average particle diameter (D1) of the toner particles are calculated as described below.

A precision particle size distribution measuring apparatus based on a pore electrical resistance method with a 100-micrometer aperture tube "Coulter Counter Multisizer 3" (trademark, manufactured by Beckman Coulter, Inc.) is used as a measuring apparatus. Dedicated software "Beckman Coulter Multisizer 3 Version 3.51" (manufactured by Beckman Coulter, Inc.) attached thereto is used for setting measurement conditions and analyzing measurement data. The measurement is performed with the number of effective measurement channels of 25,000.

An electrolyte aqueous solution prepared by dissolving special grade sodium chloride in ion-exchanged water so as to have a concentration of 1.0%, for example, "ISOTON II" (manufactured by Beckman Coulter, Inc.) may be used in the measurement.

The dedicated software is set as described below prior to the measurement and the analysis. In the "Change Standard Operating Method (SOMME)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value.

A threshold and a noise level are automatically set by pressing a "Threshold/Measure Noise Level" button. In addition, a current is set to 1,600 μA, a gain is set to 2, and an electrolyte aqueous solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) 200.0 mL of the electrolyte aqueous solution is loaded into a 250 mL round-bottom beaker made of glass dedicated for Multisizer 3. The beaker is set in a sample stand, and the electrolyte aqueous solution in the beaker is stirred with a stirrer rod at 24 revolutions/sec in a counterclockwise direction. Then, dirt and bubbles in the aperture tube are removed by the "Flush Aperture Tube" function of the dedicated software.

(2) 30.0 mL of the electrolyte aqueous solution is loaded into a 100 mL flat-bottom beaker made of glass. 0.3 mL of a diluted solution prepared by diluting "Contaminon N" (10% aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by three parts by mass fold is added as a dispersant to the electrolyte aqueous solution.

(3) An ultrasonic dispersing unit "Ultrasonic Dispersion System Tetra 150" (manufactured by Nikkaki Bios Co., Ltd.) in which two oscillators each having an oscillatory frequency of 50 kHz are built so as to be out of phase by 180° and which has an electrical output of 120 W is prepared. 3.3 L of ion-exchanged water is loaded into a water tank of the ultrasonic dispersing unit. 2.0 mL of Contaminon N is loaded into the water tank.

(4) The beaker in the section (2) is set in the beaker fixing hole of the ultrasonic dispersing unit, and the ultrasonic dispersing unit is operated. Then, the height position of the beaker is adjusted in order that the liquid surface of the electrolyte aqueous solution in the beaker may resonate with an ultrasonic wave from the ultrasonic dispersing unit to the fullest extent possible.

(5) 10 mg of the toner particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for additional 60 seconds. The temperature of water in the water tank is appropriately adjusted so as to be 10° C. or more and 40° C. or less upon ultrasonic dispersion.

(6) The electrolyte aqueous solution in the section (5) in which the toner particles have been dispersed is dropped with a pipette to the round-bottom beaker in the section (1) placed in the sample stand, and the measurement concentration is adjusted so as to be 5%. Then, measurement is performed until 50,000 particles are measured.

(7) The measurement data is analyzed with the dedicated software attached to the apparatus, and the weight-average particle diameter (D4) and the number-average particle diameter (D1) are calculated. The "Average Diameter" on the "Analysis/Volume Statistics (Arithmetic Average)" screen of the dedicated software when the dedicated software is set to show a graph in a vol % unit is the weight-average particle diameter (D4). In addition, the "Average Diameter" on the "Analysis/Number Statistics (Arithmetic Average)" screen of the dedicated software when the dedicated software is set to show a graph in a number % unit is the number-average particle diameter (D1).

<Measurement of Long Diameter of Organosilicon Polymer Particle>

A photograph of the surfaces of the toner particle is taken at a magnification of 30,000 times with FE-SEMS-4800 (manufactured by Hitachi, Ltd.). The long diameter of each of the organosilicon polymer particle was measured through use of the magnified photograph, and those having a long diameter of 30 nm or more and 300 nm or less were taken as the organosilicon polymer particle. 100 or more of the toner particles were measured, and the average value of the long diameters of the organosilicon polymer particle was taken as the long diameter of the organosilicon polymer particle.

In addition, the above-mentioned measurement is also adaptable to a toner containing a plurality of kinds of external additives on the surface of each of toner particles. When a backscattered electron image is observed with S-4800, the element of each fine particle may be identified by elemental analysis such as EDAX. In addition, the same kind of fine particles may be selected based on the feature of the shape and the like. The long diameter of each kind of fine particles may be calculated by subjecting the same kind of fine particles to the above-mentioned measurement.

<Method of Analyzing Organosilicon Polymer Particles or Organosilicon Polymer>

In solid-state $^{29}$Si-NMR, peaks are detected in different shift regions depending on the structure of a functional group that is bonded to Si of a constituent compound of the organosilicon polymer fine particles or the organosilicon polymer.

The structure that is bonded to Si may be identified by identifying each peak position through use of a standard sample. In addition, the abundance ratio of each constituent compound may be calculated from the obtained peak area. As a result, the area value of each of a peak derived from the T3 unit structure, a peak derived from the T2 unit structure, and a peak derived from the T1 unit structure may be determined.

The measurement conditions for solid-state $^{29}$Si-NMR are specifically as described below.

Device: JNM-ECX5002 (JEOL RESONANCE)
Temperature: room temperature
Measurement method: DDMAS method $^{29}$Si 45°
Sample tube: zirconia 3.2 mmφ
Sample: filled in test tube in powder form
Number of revolutions of sample: 10 kHz
Relaxation delay: 180 s
Scan: 2,000

(Measurement Conditions for Solid-State $^{13}$C-NMR)

In solid-state $^{13}$C-NMR, the amount of alkyl groups bonded to silicon atoms and the amount of alkoxy groups bonded to silicon atoms in the constituent compound of the organosilicon polymer fine particles or the organosilicon polymer may be quantified.

Device: JNM-ECX500II manufactured by JEOL RESONANCE
Sample tube: 3.2 mmφ
Sample: 150 mg of tetrahydrofuran-insoluble matter obtained by the above-mentioned preparation method
Measurement temperature: room temperature
Pulse mode: CP/MAS
Measurement core frequency: 123.25 MHz ($^{13}$C)
Reference substance: adamantane (external standard: 29.5 ppm)
Number of revolutions of sample: 20 kHz
Contact time: 2 ms
Delay time: 2 s
Number of scans: 2,000 times to 8,000 times Then, through combination of the results of $^{29}$Si-NMR and the results of $^{13}$C-NMR, the bonding amount of the alkyl groups and the bonding amount of the alkoxy groups in silicon atoms having the respective structures may be identified, and further, from the results, the bonding amount of OH groups may be calculated. Based on the obtained bonding amounts of the alkoxy groups and the OH groups, the ratio of the mass of each of an alkoxysilane structure (—Si—OR) and a silanol structure (—Si—OH) is calculated.

As a result, the ratio of the silanol structure with respect to the total of the alkoxysilane structure and the silanol structure in the T1 unit structure or the T2 unit structure in the organosilicon polymer particles or the organosilicon polymer may be identified.

Specifically, "the ratio of the content of the silanol structure with respect to the total content of the alkoxysilane structure and the silanol structure contained in the T1 unit structure or the T2 unit structure" is represented by (B+C)/(A+B+C+D)×100 through use of the following A to D:

A=Content of alkoxysilane structure contained in T1 unit structure
B=Content of silanol structure contained in T1 unit structure
C=Content of alkoxysilane structure contained in T2 unit structure
D=Content of silanol structure contained in T2 unit structure It is desired that complete quantification be performed. However, even when quantification is difficult, calculation can be performed as long as each ratio can be determined. In this case, it is only required to perform calculation by setting the "content" in the above-mentioned expression as "content ratio".

<Method of Measuring Sticking Rate of Organosilicon Polymer Fine Particles or Silica Fine Particles to Toner Particles by Water Washing Method>

(Water Washing Step)

20 g of "Contaminon N" (30 mass % aqueous solution of a neutral detergent for washing a precision measuring device formed of a nonionic surfactant, an anionic surfactant, and an organic builder and having a pH of 7) is weighed into a vial having a volume of 50 mL and mixed with 1 g of a toner. The vial is set in "KM Shaker" (model: V.SX) manufactured by Iwaki Industry Co., Ltd., and is shaken for 120 seconds with the speed set to 50. As a result, the organosilicon polymer fine particles are transferred from the surfaces of the toner particles to the dispersion liquid side depending on the sticking state of the organosilicon polymer fine particles or the silica fine particles. After that, the toner and the organosilicon polymer fine particles or the silica fine particles transferred to the supernatant liquid are separated with a centrifuge (H-9R; manufactured by Kokusan Co., Ltd.) (16.67 $S^{-1}$ for 5 minutes). The precipitated toner is brought into dryness by vacuum drying (40° C./24 hours) to provide a toner after water washing. Next, through use of a Hitachi ultra-high resolution field emission-type scanning electron microscope S-4800 (Hitachi High-Technologies Corporation), surface images of the toner that is not subjected to the water washing step (toner before water washing) and the toner obtained through the water washing step (toner after water washing) are taken. Then, the taken toner surface images are analyzed through use of image analysis software Image-Pro Plus ver. 5.0 (Nippon Roper K.K.) to calculate a coating ratio.

The conditions for taking an image with S-4800 are as described below.

(1) Sample Preparation

A conductive paste is thinly applied to a sample stage (aluminum sample stage: 15 mm×6 mm), and a toner is sprayed onto the conductive paste. Further, air blowing is performed to remove an excess toner from the sample stage, to thereby sufficiently dry the sample stage. The sample stage is set on a sample holder, and the height of the sample stage is adjusted to 36 mm with a sample height gauge.

(2) S-4800 Observation Condition Setting

The coating ratio is measured after performing elemental analysis by the energy dispersive X-ray spectroscopy (EDS) described above to distinguish the organosilicon polymer fine particles or the silica fine particles on the surfaces of the toner particles in advance.

Liquid nitrogen is injected into an anti-contamination trap mounted to a housing of S-4800 until the liquid nitrogen overflows, and the resultant is allowed to stand for 30 minutes. "PC-SEM" of S-4800 is activated to perform flushing (cleaning of an FE chip that is an electron source). An acceleration voltage display part of a control panel on the screen is clicked, and a [Flushing] button is pressed, to thereby open a flushing execution dialog. The flushing intensity is recognized to be 2, and the flushing is performed. The emission current by the flushing is recognized to be from 20 μA to 40 μA. The sample holder is inserted into a sample chamber of the housing of S-4800. An [Origin] button of the control panel is pressed to move the sample holder to an observation position.

The acceleration voltage display part is clicked to open an HV setting dialog. The acceleration voltage is set to [1.1 kV], and the emission current is set to [20 μA]. In a [Basic] tab of an operation panel, signal selection is set to [SE]. [Upper (U)] and [+BSE] for an SE detector are selected, and [L.A.100] is selected in a selection box of the [+BSE] to set a mode for observation in a backscattered electron image. Similarly, in the [Basic] tab of the operation panel, the probe current in an electron optical system condition block is set to [Normal], the focus mode is set to [UHR], and the WD is set to [4.5 mm]. An [ON] button in the acceleration voltage display part of the control panel is pressed to apply an acceleration voltage.

(3) Calculation of Number-Average Particle Diameter (D1) of Toner

Dragging is performed within a magnification display part of the control panel to set the magnification to 5,000 (5 k) times. A focus knob [COARSE] of the operation panel is turned, and the aperture alignment is adjusted when the focusing is achieved to some extent. [Align] of the control panel is clicked to display an alignment dialog, and [Beam] is selected. STIGMA/ALIGNMENT knobs (X, Y) of the operation panel are turned to move a displayed beam to the center of a concentric circle. Next, [Aperture] is selected, and the STIGMA/ALIGNMENT knobs (X, Y) are turned one by one, to thereby make adjustment so as to stop the movement of an image or minimize the movement. An aperture dialog is closed, and the image is brought into focus with an autofocus. This operation is further repeated twice to bring the image into focus. After that, the particle diameter of each of 300 toner particles is measured to obtain a number-average particle diameter (D1). The particle diameter of each of the particles is defined as a maximum diameter when the toner particles are observed.

(4) Focus Adjustment

Regarding the particles having a number-average particle diameter (D1) of ±0.1 μm obtained in the section (3), dragging is performed within the magnification display part of the control panel under a state in which the middle point of the maximum diameter is aligned with the center of a measurement screen, to thereby set the magnification to 10,000 (10 k) times. The focus knob [COARSE] of the operation panel is turned, and the aperture alignment is adjusted when the focusing is achieved to some extent. The [Align] of the control panel is clicked to display the alignment dialog, and the [Beam] is selected. The STIGMA/ALIGNMENT knobs (X, Y) of the operation panel are turned to move a displayed beam to the center of a concentric circle. Next, the [Aperture] is selected, and the STIGMA/ALIGNMENT knobs (X, Y) are turned one by one, to thereby make adjustment so as to stop the movement of an image or minimize the movement. The aperture dialog is closed, and the image is brought into focus with an autofocus. After that, the magnification is set to 50,000 (50 k) times, focus adjustment is performed through use of the focus knob and the STIGMA/ALIGNMENT knobs in the same manner as above, and the image is brought into focus with an autofocus again. This operation is repeated again to bring the image into focus. Here, when the inclination angle of an observation surface is large, the measurement accuracy of the coating ratio becomes liable to be lowered. Accordingly, at the time of focus adjustment, adjustment is selected so that the entire observation surface is simultaneously brought into focus, to thereby select and analyze the observation surface having minimum inclination.

(5) Image Saving

Brightness is adjusted in an ABC mode, and a photograph is taken and saved with a size of 640×480 pixels. The following analysis is performed through use of this image file. One photograph is taken for one toner, and an image is obtained for 25 toner particles.

(6) Image Analysis

The coating ratio is calculated by binarizing the image obtained by the above-mentioned method through use of the analysis software described below. In this case, the above-mentioned one screen is divided into 12 squares, and each of the squares is analyzed. Analysis conditions of image analysis software Image-Pro Plus ver. 5.0 are as described below. However, when, in the divided section, there are organosilicon polymer fine particles each having a particle diameter of less than 30 nm and more than 300 nm (in the case of measuring the coating ratio of the organosilicon polymer fine particles), and silica fine particles each having a particle diameter of less than 100 nm and more than 300 nm (in the case of measuring the coating ratio of the silica fine particles), the calculation of the coating ratio is not performed in that section. "Count/size" and "Option" are selected in the stated order from "Measurement" in a tool bar of software Image-Pro Plus 5.1 J, and the binarization conditions are set. 8-connection is selected from object extraction options, and smoothing is set to 0. In addition, preselection, filling of holes, and comprehensive lines are not selected, and "Exclude borders" is set to "None". "Measurement item" is selected from the "Measurement" in the tool bar, and 2 to 107 are input to the selection range of an area.

The coating ratio is calculated by enclosing a square region. In this case, an area (C) of the region is set to from 24,000 pixels to 26,000 pixels. Automatic binarization is performed in "Processing"-binarization, and a total (D) of areas of regions without the organosilicon polymer fine particles or the silica fine particles is calculated. From the area C of the square region and the total D of the areas of the regions without the organosilicon polymer fine particles or the silica fine particles, the coating ratio is determined by the following expression.

$$\text{Coating ratio (\%)}=100-(D/C\times 100)$$

The arithmetic average value of all the data obtained is taken as the coating ratio. Then, the coating ratio of each of the toner before water washing and the toner after water washing is calculated.

[Coating Ratio of toner after water washing]/[coating ratio of toner before water washing]×100 is defined as the "sticking rate" of the present invention.

<Method of Measuring Average Circularity>

The average circularity of the toner particles is measured by a flow-type particle image analyzer "FPIA-3000" (manufactured by Sysmex Corporation) under measurement and analysis conditions at the time of calibration work. A specific measurement method is as described below. First, about 20 ml of ion-exchanged water having solid impurities and the like removed therefrom in advance is loaded into a container made of glass. About 0.2 ml of a diluted solution prepared by diluting "Contaminon N" (10 mass % aqueous solution of a neutral detergent for washing a precision measuring device formed of a nonionic surfactant, an anionic surfactant, and an organic builder and having a pH of 7, manufactured by Wako Pure Chemical Industries, Ltd.) with ion-exchanged water by about three parts by mass fold is added as a dispersant to the ion-exchanged water. Further, about 0.02 g of a measurement sample is added to the resultant, and dispersion treatment is performed for 2 minutes with an ultrasonic disperser to provide a dispersion liquid for measurement. In this case, the dispersion liquid is appropriately cooled so that the temperature thereof reaches 10° C. or more and 40° C. or less. As the ultrasonic disperser, a tabletop ultrasonic cleaner disperser having an oscillation frequency of 50 kHz and an electrical output of 150 W (for example, "VS-150" (manufactured by Velvo-Clear Co.)) is used. A predetermined amount of ion-exchanged water is loaded into a water tank, and about 2 ml of the Contaminon N is added to the water tank. For the measurement, the flow-type particle image analyzer equipped with "UPlanA-pro" (magnification: 10 times, numerical aperture: 0.40) as an objective lens is used, and a particle sheath "PSE-900A" (manufactured by Sysmex Corporation) is used as a sheath liquid. The dispersion liquid prepared according to the above-mentioned procedure is introduced into the flow-type particle image analyzer, and 3,000 toner particles are measured in an HPF measurement mode and a total count mode. Then, the binarization threshold at the time of particle analysis is set to 85%, and the analysis particle diameter is limited to a circle-equivalent diameter of 1.985 μm or more and less than 39.69 μm, to thereby determine the average circularity of the toner particles.

For measurement, automatic focus adjustment is performed through use of standard latex particles (for example, "RESEARCH AND TEST PARTICLES Latex Microsphere Suspensions 5200A" manufactured by Duke Scientific diluted with ion-exchanged water) before the start of the measurement. After that, focus adjustment is performed every two hours from the start of the measurement.

(Production Examples of Anatase-Type Titanium Oxide Particles 1 to 7)

A solution containing titanyl sulfate was heated and hydrolyzed to produce a hydrous titanium dioxide slurry, and the titanium dioxide slurry was subjected to dehydration calcination, to thereby provide anatase-type titanium oxide particles. Through control of the concentration of the titanyl sulfate solution, the number-average particle diameter of the anatase-type titanium oxide particles was controlled, and anatase-type titanium oxide particles 1 to 7 shown in Table 1 were obtained.

TABLE 1

| Core | |
|---|---|
| Kind | Number-average particle diameter (nm) |
| Anatase-type titanium oxide particle 1 | 150 |
| Anatase-type titanium oxide particle 2 | 160 |
| Anatase-type titanium oxide particle 3 | 190 |
| Anatase-type titanium oxide particle 4 | 280 |
| Anatase-type titanium oxide particle 5 | 200 |
| Anatase-type titanium oxide particle 6 | 80 |
| Anatase-type titanium oxide particle 7 | 170 |

<Production of Electroconductive Particle>

(Production of Electroconductive Particle 1)

100 g of anatase-type titanium oxide particle 1 were dispersed in water to provide 1 L of an aqueous suspension, and the suspension was heated to 60° C. A titanium-niobium acid solution that was a mixture of a niobium solution in which 3 g of niobium pentachloride ($NbCl_5$) was dissolved in 100 mL of 11.4 mol/L hydrochloric acid and 600 mL of a titanium sulfate solution containing 33.7 g of titanium (weight ratio between niobium atoms and titanium atoms in the liquid is 1.0/33.7) and a 10.7 mol/L sodium hydroxide aqueous solution were simultaneously added dropwise (parallel addition) to the suspension over 3 hours so that the pH of the suspension became from 2 to 3. After the completion of the dropwise addition, the suspension was filtered, washed, and dried at 110° C. for 8 hours. This dried product was subjected to heating treatment (calcination treatment) at 800° C. for 1 hour in an air atmosphere, to thereby provide niobium atom-containing titanium oxide particles 1.

Next, the following materials were prepared.

| | |
|---|---|
| Niobium atom-containing titanium oxide particle 1 | 100.0 parts |
| Surface treatment agent 1 (the following formula (S-1)) (product name: KBM-3033, manufactured by Shin-Etsu Chemical Co., Ltd.) | 3.0 parts |

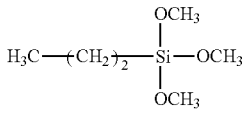

(S-1)

| | |
|---|---|
| Toluene | 200.0 parts |

Those materials were mixed, and the mixture was stirred with a stirring apparatus for 4 hours. After that, the resultant was filtered and washed, and then was subjected to heating treatment at 130° C. for 3 hours, to thereby provide electroconductive particle 1. The physical properties of surfaces and particle diameters of the electroconductive particle are shown in Table 2.

(Production of Electroconductive Particles 2 to 9 and 14)

The kind of the core to be used, the concentration and amount of the titanium-niobium acid solution, and the conditions at the time of coating were appropriately changed in the production of the electroconductive particle 1. Powders of electroconductive particles 2 to 9 and 14 were obtained in the same manner as in the production of the electroconductive particle 1 except for the foregoing. The content in Table 2 is the content of niobium atoms in the niobium atom-containing titanium oxide particles, and is a value obtained through measurement by an elemental analysis method using fluorescent X-rays (XRF). The electroconductive particle 9 are the same as the anatase-type titanium oxide particle 7.

(Production of Electroconductive Particle 10)

The following materials were prepared.

| | |
|---|---|
| Tin oxide particles (product name: S-2000, manufactured by Mitsubishi Materials Corporation) | 100.0 parts |
| Surface treatment agent 2 (the following formula (S-2)) (product name: decyltrimethoxysilane, manufactured by Tokyo Chemical Industry Co., Ltd.) | 20.0 parts |
| Toluene | 200.0 parts |

Those materials were mixed, and the mixture was stirred with a stirring apparatus for 4 hours. After that, the resultant was filtered, washed, and then was subjected to heating treatment at 130° C. for 3 hours for surface treatment. The physical properties of surfaces and particle diameters of the electroconductive particle are shown in Table 2.

(S-2)

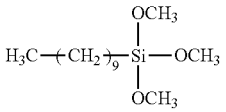

(Production of Electroconductive Particle 11)

Substantially spherical anatase-type titanium dioxide particles 8 having a number-average particle diameter of 6 nm and a niobium atom content of 0.50 mass % were used as electroconductive particle 11. The physical properties of the electroconductive particle 11 are shown in Table 2.

(Production of Electroconductive Particle 12)

Substantially spherical anatase-type titanium oxide 9 having a number-average particle diameter of 150 nm and a niobium atom content of 0.20 mass % was used as a core to be used in the production of the electroconductive particle 1, and the conditions at the time of coating in the production of the electroconductive particle 1 is changed. Electroconductive particle 12 is produced in the same manner as in the production of the electroconductive particle 1 except for the foregoing. The physical properties of the electroconductive particle 12 are shown in Table 2.

(Production of Electroconductive Particle 13)

Niobium sulfate (water-soluble niobium compound) was added to a hydrous titanium dioxide slurry obtained by hydrolyzing a titanyl sulfate aqueous solution. Regarding its addition amount, niobium sulfate was added at a ratio of 0.2 mass % in terms of niobium ions with respect to the amount of titanium (in terms of titanium dioxide) in the slurry. The titanyl sulfate aqueous solution having niobium sulfate added thereto as niobium ions in a ratio of 0.2 mass % was hydrolyzed to provide a hydrous titanium dioxide slurry. Next, the hydrous titanium dioxide slurry containing niobium ions and the like was dehydrated and calcined at a calcination temperature of 1,000° C. As a result, anatase-type titanium oxide particles 10 having a number-average particle diameter of 130 nm and containing 0.2 mass % of niobium atoms were obtained.

100 g of 0.2 wt % spherical anatase-type titanium oxide particle 10 having a number-average particle diameter of 130 nm were dispersed in water to provide 1 L of an aqueous suspension, and the suspension was heated to 60° C. A titanium acid solution having 600 mL of a titanium sulfate solution containing 33.7 g of titanium mixed therewith and a 10.7 mol/L sodium hydroxide solution were simultaneously added dropwise (parallel addition) to the suspension over 3 hours so that the pH of the suspension became from 2 to 3. After the completion of the dropwise addition, the suspension was filtered, washed, and dried at 110° C. for 8 hours. This dried product was subjected to heating treatment at 800° C. for 1 hour in an air atmosphere. Thus, electroconductive particles 13 were obtained.

The physical properties of the electroconductive particle 13 are shown in Table 2.

TABLE 2

| | Particles before coating | | | | | | |
|---|---|---|---|---|---|---|---|
| | Number-average particle diameter (nm) | Kind | Number-average particle diameter (nm) | Coating material Kind | Surface treatment agent | A/B | Nb content in particles (mass %) |
| Electroconductive particle 1 | 170 | Anatase-type titanium oxide particle 1 | 150 | Nb-containing titanium oxide | Surface treatment agent 1 | 7.9 | 5.0 |
| Electroconductive particle 2 | 180 | Anatase-type titanium oxide particle 2 | 160 | Nb-containing titanium oxide | Surface treatment agent 1 | 7.9 | 5.0 |
| Electroconductive particle 3 | 210 | Anatase-type titanium oxide particle 3 | 190 | Nb-containing titanium oxide | Surface treatment agent 1 | 4.1 | 2.6 |

TABLE 2-continued

| | Number-average particle diameter (nm) | Particles before coating: Kind | Number-average particle diameter (nm) | Coating material Kind | Surface treatment agent | A/B | Nb content in particles (mass %) |
|---|---|---|---|---|---|---|---|
| Electroconductive particle 4 | 300 | Anatase-type titanium oxide particle 4 | 280 | Nb-containing titanium oxide | Surface treatment agent 1 | 12.6 | 8.0 |
| Electroconductive particle 5 | 100 | Anatase-type titanium oxide particle 6 | 80 | Nb-containing titanium oxide | Surface treatment agent 1 | 4.1 | 2.6 |
| Electroconductive particle 6 | 220 | Anatase-type titanium oxide particle 5 | 200 | Nb-containing titanium oxide | Surface treatment agent 1 | 1.7 | 1.1 |
| Electroconductive particle 7 | 170 | Anatase-type titanium oxide particle 1 | 150 | Nb-containing titanium oxide | Surface treatment agent 1 | 15.8 | 10.0 |
| Electroconductive particle 8 | 170 | Anatase-type titanium oxide particle 1 | 150 | Nb-containing titanium oxide | Surface treatment agent 1 | 0.8 | 0.5 |
| Electroconductive particle 9 | 170 | Anatase-type titanium oxide particle 7 | 170 | — | Surface treatment agent 1 | 0.0 | 0.0 |
| Electroconductive particle 10 | 20 | Tin oxide particle | 20 | — | Surface treatment agent 2 | 0.0 | 0.0 |
| Electroconductive particle 11 | 6 | Nb-containing anatase-type titanium oxide particle 8 | 6 | — | Surface treatment agent 3 | 0.8 | 0.5 |
| Electroconductive particle 12 | 170 | Nb-containing anatase-type titanium oxide particle 9 | 150 | Nb-containing titanium oxide | Surface treatment agent 1 | 7.9 | 5.0 |
| Electroconductive particle 13 | 150 | Nb-containing anatase-type titanium oxide particle 10 | 130 | Titanium oxide | Surface treatment agent 1 | 0.0 | 0.1 |
| Electroconductive particle 14 | 190 | Anatase-type titanium oxide particle 7 | 170 | Nb-containing titanium oxide | Surface treatment agent 1 | 23.7 | 15.0 |

In the table, A represents the "concentration ratio between the niobium atom and the titanium atom at the inside portion at 5% of the maximum diameter of the measurement particle from the surface of the particle," and B represents the "concentration ratio between the niobium atom and the titanium atom at the central portion of the particle."

<Production Example 1 of Electrophotographic Photosensitive Member>

An aluminum cylinder having a diameter of 24 mm and a length of 257.5 mm (JIS-A3003, aluminum alloy) was used as a support (electroconductive support).

(Production Example 1 of Conductive Layer)

Next, the following materials were prepared.

| | |
|---|---|
| Titanium oxide ($TiO_2$) particles (volume-average particle diameter: 230 nm) coated with oxygen-deficient tin oxide ($SnO_2$) serving as metal oxide particles | 214 parts |
| Phenolic resin (monomer/oligomer of phenolic resin) serving as a binding material (product name: PLYOPHEN J-325, manufactured by DIC Corporation, resin solid content: 60 mass %) | 132 parts |
| 1-Methoxy-2-propanol serving as a solvent | 98 parts |

Those materials were placed in a sand mill using 450 parts of glass beads each having a diameter of 0.8 mm, and were subjected to dispersion treatment under the conditions of a rotation speed of 2,000 rpm, a dispersion treatment time of 4.5 hours, and a preset temperature of cooling water of 18° C. to provide a dispersion liquid. The glass beads were removed from the dispersion liquid with a mesh (aperture: 150 μm). To the resultant dispersion liquid, silicone resin particles (product name: TOSPEARL 120, manufactured by Momentive Performance Materials, average particle diameter: 2 μm) serving as a surface roughness-imparting material were added. The addition amount of the silicone resin particles was set to 10 mass % with respect to the total mass of the metal oxide particles and the binding material in the dispersion liquid after the removal of the glass beads. In addition, a silicone oil (product name: SH28PA, manufactured by Dow Corning Toray Co., Ltd.) serving as a leveling agent was added to the dispersion liquid at 0.01 mass % with respect to the total mass of the metal oxide particles and the binding material in the dispersion liquid.

Next, a mixed solvent of methanol and 1-methoxy-2-propanol (mass ratio: 1:1) was added to the dispersion liquid so that the total mass of the metal oxide particles, the binding material, and the surface roughness-imparting material (i.e., the mass of the solid content) in the dispersion liquid became 67 mass % with respect to the mass of the dispersion liquid. After that, the mixture was stirred to prepare a coating liquid for a conductive layer. The coating liquid for a conductive layer was applied onto the support by dip coating, and the resultant was heated at 140° C. for 1 hour to form a conductive layer having a thickness of 30 μm.

(Production Example 1 of Undercoat Layer)

Next, the following materials were prepared.

| | |
|---|---|
| Electron-transporting substance represented by the following formula (E-1) | 3.11 parts |
| Blocked isocyanate (product name: DURANATE SBB-70P, manufactured by Asahi Kasei Chemicals Corporation) | 6.49 parts |

-continued

| | |
|---|---|
| Styrene-acrylic resin (product name: UC-3920, manufactured by Toagosei Co., Ltd.) | 0.4 part |
| Silica slurry (product name: IPA-ST-UP, manufactured by Nissan Chemical Industries, Ltd., solid content concentration: 15 mass %, viscosity: 9 mPa · s) | 1.8 parts |

Those materials were dissolved in a mixed solvent of 48 parts of 1-butanol and 24 parts of acetone to prepare a coating liquid for an undercoat layer. The coating liquid for an undercoat layer was applied onto the conductive layer by dip coating, followed by heating at 170° C. for 30 minutes to form an undercoat layer having a thickness of 0.7 μm.

(E-1)

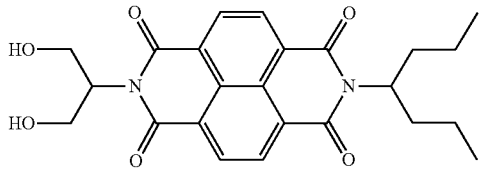

Next, 10 parts of hydroxygallium phthalocyanine of a crystal form having peaks at positions of 7.5° and 28.4° in a chart obtained by CuKα characteristic X-ray diffraction and 5 parts of a polyvinyl butyral resin (product name: S-LEC BX-1, manufactured by Sekisui Chemical Co., Ltd.) were prepared. Those materials were added to 200 parts of cyclohexanone, and the mixture was dispersed with a sand mill apparatus using glass beads each having a diameter of 0.9 mm for 6 hours. The resultant was diluted by further adding 150 parts of cyclohexanone and 350 parts of ethyl acetate thereto to provide a coating liquid for a charge-generating layer. The resultant coating liquid was applied onto the undercoat layer by dip coating, followed by drying at 95° C. for 10 minutes to form a charge-generating layer having a thickness of 0.20 μm.

The X-ray diffraction measurement was performed under the following conditions.

[Powder X-Ray Diffraction Measurement]

Measurement machine used: X-ray diffraction apparatus RINT-TTRII, manufactured by Rigaku Corporation X-ray tube: Cu Tube voltage: 50 KV Tube current: 300 mA Scanning method: 2θ/θ scan Scanning speed: 4.0°/min Sampling interval: 0.02°

Start angle (2θ): 5.0°

Stop angle (2θ): 40.0°

Attachment: standard sample holder

Filter: not used

Incident monochrometer: used

Counter monochrometer: not used

Divergence slit: open

Divergence longitudinal restriction slit: 10.00 mm

Scattering slit: open

Light receiving slit: open

Flat plate monochrometer: used

Counter: scintillation counter (Production Example 1 of Photosensitive Layer)

Next, the following materials were prepared.

| | |
|---|---|
| Charge-transporting substance (hole-transportable substance) represented by the following formula (C-1) | 6 parts |
| Charge-transporting substance (hole-transportable substance) represented by the following formula (C-2) | 3 parts |
| Charge-transporting substance (hole-transportable substance) represented by the following formula (C-3) | 1 part |
| Polycarbonate (product name: lupilon Z400, manufactured by Mitsubishi Engineering-Plastics Corporation) | 10 parts |
| Polycarbonate resin having a copolymerization unit of the following formula (C-4) and the following formula (C-5) (x/y = 0.95/0.05: viscosity-average molecular weight = 20,000) | 0.02 part |

Those materials were dissolved in a mixed solvent of 25 parts of o-xylene, 25 parts of methyl benzoate, and 25 parts of dimethoxymethane to prepare a coating liquid for a charge-transporting layer. The coating liquid for a charge-transporting layer was applied onto the charge-generating layer by dip coating to form a coating film, and the coating film was dried at 120° C. for 30 minutes to form a charge-transporting layer having a thickness of 12 μm.

(C-1)

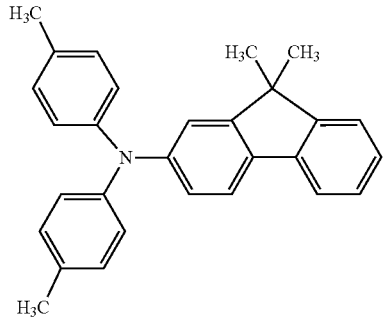

(C-2)

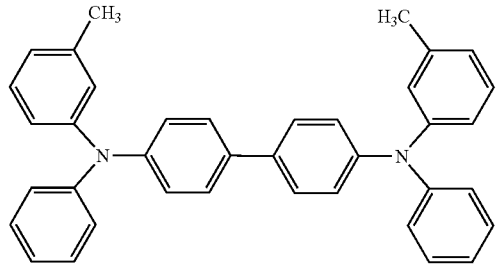

(C-3)

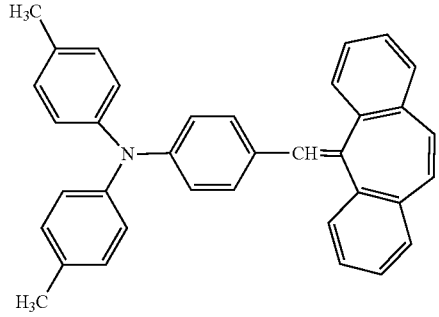

-continued (C-4)

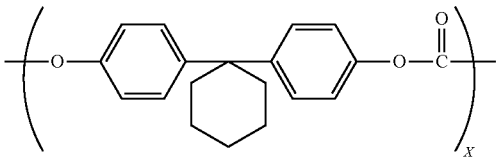

(C-5)

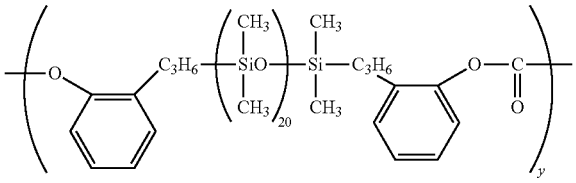

(Production Example 1 of Surface Protective Layer)

Next, the following materials were prepared.

| | |
|---|---|
| Compound represented by the following structural formula (O-1) serving as a binder resin | 100.0 parts |
| Niobium atom-containing titanium oxide particles subjected to the above-mentioned surface treatment serving as electroconductive particles 1 | 100.0 parts |

Those materials were mixed with a mixed solvent of 100 parts of 1-propanol and 100 parts of cyclohexane, and the mixture was stirred with a stirring apparatus for 6 hours. Thus, a coating liquid for a surface protective layer was prepared. The coating liquid for a surface protective layer was applied onto the charge-transporting layer by dip coating to form a coating film, and the resultant coating film was dried at 50° C. for 6 minutes. After that, under a nitrogen atmosphere, the coating film was irradiated with electron beams for 1.6 seconds under the conditions of an acceleration voltage of 70 kV and a beam current of 5.0 mA while the support (irradiation target body) was rotated at a speed of 300 rpm. The dose of the electron beams at a position on the surface protective layer of the support was 15 kGy.

After that, under the nitrogen atmosphere, the temperature of the coating film was increased to 117° C. An oxygen concentration during a period from the electron beam irradiation to the subsequent heating treatment was 10 ppm.

Next, in the air, the coating film was naturally cooled until its temperature became 25° C., and then heating treatment was performed for 1 hour under such a condition that the temperature of the coating film became 120° C., to thereby form a surface protective layer having a thickness of 2 μm. Thus, an electrophotographic photosensitive member 1 was produced.

(O-1)

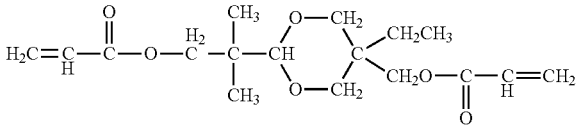

(Production Examples 2 to 20, 24, and 25 of Electrophotographic Photoreceptor Member)

Electrophotographic photosensitive members 2 to 20, 24, and 25 each having the volume resistivity of the surface protective layer and the content (vol %) of the electroconductive particle in the protective layer shown in Table 3 were produced in the same manner as in Production Example 1 of the electrophotographic photosensitive member except that the kind of the electroconductive particle and the number of parts of addition of the electroconductive particle in the surface protective layer were appropriately changed.

(Production Example 21 of Electrophotographic Photosensitive Member)

A coating liquid for a surface protective layer was prepared as described below. First, the following materials were prepared.

| | |
|---|---|
| Radically polymerizable monomer (product name: TMPTA, manufactured by Tokyo Chemical Industry Co., Ltd.) serving as a binder resin | 100.0 parts |
| Compound represented by the following formula (H-1) | 50.0 parts |
| Compound represented by the following formula (H-2) | 1.5 parts |
| Compound represented by the following formula (H-3) | 1.5 parts |
| Fluorine resin particles (product name: MPE-056, manufactured by Mitsui DuPont Fluorochemical Co., Ltd.) | 15.0 parts |
| Photopolymerization initiator (product name: IRGACURE 184, manufactured by BASF Japan Ltd.) | 7.5 parts |

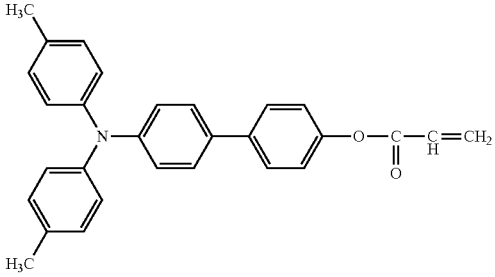

(H-1)

-continued

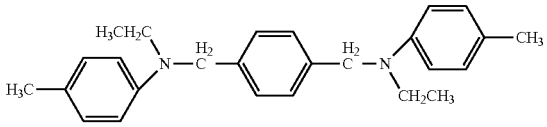

(H-2)

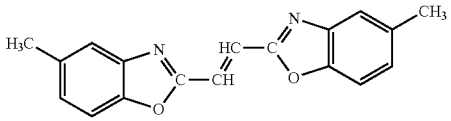

(H-3)

Those materials were mixed with 1,000 parts of tetrahydrofuran, and the mixture was stirred with a stirring apparatus for 6 hours, to thereby prepare a coating liquid for a surface protective layer. The coating liquid for a surface protective layer was applied onto the charge-transporting layer by a spray coating method in a nitrogen stream to form a coating film. The resultant was allowed to stand in a nitrogen stream for 10 minutes to perform finger touch drying. After that, UV light irradiation was performed under the following conditions in a UV light irradiation booth in which the inside of the booth was purged with nitrogen gas so that the concentration of oxygen became 2% or less.

Metal halide lamp: 160 W/cm

Irradiation distance: 120 mm

Irradiation intensity: 700 mW/cm$^2$

Irradiation time: 60 seconds

Further, the resultant was dried at 130° C. for 20 minutes to form a surface protective layer having a thickness of 5 μm. An electrophotographic photosensitive member 21 was obtained in the same manner as in Example 1 except for the foregoing.

(Production Example 22 of Electrophotographic Photosensitive Member)

An electrophotographic photosensitive member 22 was obtained in the same manner as in Production Example 21 of the electrophotographic photosensitive member except that the number of parts of addition was changed so that the content of the electroconductive particle became 42.0% with respect to the total volume of the surface protective layer in the preparation of the coating liquid for a surface protective layer in Production Example 21 of the electrophotographic photosensitive member.

(Production Example 23 of Electrophotographic Photosensitive Member)

| | |
|---|---|
| Electroconductive particle 11 | 100.0 parts |
| Compound represented by the following formula (H-7) | 100.0 parts |
| Polymerization initiator (1-hydroxy cyclohexyl(phenyl)methanone) | 10 parts |

Those materials were mixed with 400.0 parts of n-propyl alcohol and dispersed therein with a sand mill for 2 hours to prepare a coating liquid for a protective layer. An electrophotographic photosensitive member 23 was obtained by producing an electrophotographic photosensitive member in the same manner as in Production Example 21 of the electrophotographic photosensitive member except for using the above-mentioned coating liquid for a protective layer.

(H-7)

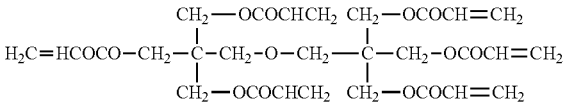

TABLE 3

| Electrophotographic photosensitive member | Volume [Ω · cm] resistivity | Electroconductive particle Kind | Electroconductive particle Content ratio (vol %) |
|---|---|---|---|
| Electrophotographic photosensitive member 1 | $2.8 \times 10^{13}$ | Electroconductive particle 1 | 20 |
| Electrophotographic photosensitive member 2 | $8.6 \times 10^{13}$ | Electroconductive particle 1 | 7 |
| Electrophotographic photosensitive member 3 | $1.0 \times 10^{14}$ | Electroconductive particle 1 | 5 |
| Electrophotographic photosensitive member 4 | $5.7 \times 10^{12}$ | Electroconductive particle 1 | 38 |
| Electrophotographic photosensitive member 5 | $4.8 \times 10^{12}$ | Electroconductive particle 1 | 40 |
| Electrophotographic photosensitive member 6 | $2.2 \times 10^{12}$ | Electroconductive particle 1 | 50 |
| Electrophotographic photosensitive member 7 | $7.7 \times 10^{12}$ | Electroconductive particle 1 | 67 |
| Electrophotographic photosensitive member 8 | $1.0 \times 10^{9}$ | Electroconductive particle 2 | 70 |
| Electrophotographic photosensitive member 9 | $5.2 \times 10^{10}$ | Electroconductive particle 1 | 70 |
| Electrophotographic photosensitive member 10 | $1.0 \times 10^{14}$ | Electroconductive particle 3 | 40 |
| Electrophotographic photosensitive member 11 | $5.0 \times 10^{12}$ | Electroconductive particle 4 | 20 |
| Electrophotographic photosensitive member 12 | $1.4 \times 10^{13}$ | Electroconductive particle 5 | 20 |
| Electrophotographic photosensitive member 13 | $7.2 \times 10^{13}$ | Electroconductive particle 7 | 20 |
| Electrophotographic photosensitive member 14 | $4.3 \times 10^{12}$ | Electroconductive particle 6 | 50 |
| Electrophotographic photosensitive member 15 | $1.3 \times 10^{11}$ | Electroconductive particle 9 | 15 |
| Electrophotographic photosensitive member 16 | $6.3 \times 10^{10}$ | Electroconductive particle 9 | 20 |
| Electrophotographic photosensitive member 17 | $6.3 \times 10^{9}$ | Electroconductive particle 10 | 20 |
| Electrophotographic photosensitive member 18 | $1.1 \times 10^{11}$ | Electroconductive particle 1 | 71 |
| Electrophotographic photosensitive member 19 | $2.0 \times 10^{14}$ | Electroconductive particle 8 | 45 |
| Electrophotographic photosensitive member 20 | $5.0 \times 10^{8}$ | Electroconductive particle 14 | 75 |
| Electrophotographic photosensitive member 21 | $6.4 \times 10^{14}$ | Absent | 0 |

TABLE 3-continued

| Electrophotographic photosensitive member | Volume [Ω · cm] resistivity | Electroconductive particle Kind | Electroconductive particle Content ratio (vol %) |
|---|---|---|---|
| Electrophotographic photosensitive member 22 | $3.0 \times 10^{8}$ | Electroconductive particle 10 | 42 |
| Electrophotographic photosensitive member 23 | $4.6 \times 10^{13}$ | Electroconductive particle 11 | 19 |
| Electrophotographic photosensitive member 24 | $2.8 \times 10^{13}$ | Electroconductive particle 12 | 20 |
| Electrophotographic photosensitive member 25 | $6.3 \times 10^{10}$ | Electroconductive particle 13 | 20 |

<Production Example of Toner>

<Production Example of Toner Base Particle-Dispersed Liquid>

<Toner Base Particle-Dispersed Liquid 1>

11.2 Parts of sodium phosphate (dodecahydrate) was loaded into a reaction vessel containing 390.0 parts of ion-exchanged water to prepare an aqueous solution of sodium phosphate. The temperature of the aqueous solution was held at 65° C. for 1.0 hour while the reaction vessel was purged with nitrogen. The aqueous solution of sodium phosphate was stirred with a T.K. homomixer (manufactured by Tokushu Kika Kogyo Co., Ltd.) at 12,000 rpm. An aqueous solution of calcium chloride obtained by dissolving 7.4 parts of calcium chloride (dihydrate) in 10.0 parts of ion-exchanged water was collectively loaded into the reaction vessel under stirring to prepare an aqueous medium containing a dispersion stabilizer. Further, 1.0 mol/L hydrochloric acid was loaded into the aqueous medium in the reaction vessel to adjust the pH thereof to 6.0, to thereby prepare an aqueous medium 1.

(Preparation of Polymerizable Monomer Composition)

| | |
|---|---|
| Styrene | 60.0 parts |
| C.I. Pigment Blue 15:3 | 6.5 parts |

The above-mentioned materials were loaded into an attritor (manufactured by Nippon Coke & Engineering Co., Ltd.), and were dispersed with zirconia particles each having a diameter of 1.7 mm at 220 rpm for 5.0 hours to prepare a colorant-dispersed liquid having a pigment dispersed therein.

Next, the following materials were added to the colorant-dispersed liquid.

| | |
|---|---|
| Styrene | 10.0 parts |
| n-Butyl acrylate | 30.0 parts |
| Polyester resin (polycondensate of terephthalic acid and a propylene oxide 2-mol adduct of bisphenol A, weight-average molecular weight Mw = 10,000, acid value: 8.2 mgKOH/g) | 5.0 parts |
| Releasable wax: HNP-9 (melting point: 76° C., manufactured by Nippon Seiro Co., Ltd.) | 5.0 parts |
| Thermoplastic wax: ethylene glycol distearate | 10.0 parts |

The above-mentioned materials were kept at 65° C., and were uniformly dissolved and dispersed with the T.K. homomixer at 500 rpm to prepare a polymerizable monomer composition.

(Granulation Step)

While the temperature of the aqueous medium 1 was kept at 70° C. and the number of revolutions of a stirring apparatus was kept at 12,500 rpm, the polymerizable monomer composition was loaded into the aqueous medium 1, and 8.0 parts of t-butyl peroxypivalate serving as a polymerization initiator was added to the mixture. The resultant was granulated as it was with the stirring apparatus for 10 minutes while the number of revolutions was maintained at 12,500 rpm.

(Polymerization Step)

The high-speed stirring apparatus was changed to a stirring machine including a propeller stirring blade, and the granulated product was held at 70° C. and polymerized for 5.0 hours under stirring at 200 rpm. Further, a polymerization reaction was performed by increasing the temperature to 85° C. and heating the resultant at the temperature for 2.0 hours. Further, the residual monomer was removed by increasing the temperature to 98° C. and heating the resultant at the temperature for 3.0 hours. Ion-exchanged water was added to adjust the concentration of toner base particles in the resultant dispersion liquid to 30.0%. Thus, a toner base particle-dispersed liquid 1 having dispersed therein the toner base particles 1 was obtained.

<Production of Organosilicon Polymer Particle>

Organosilicon polymer fine particles 1 were prepared by the following procedure. In a first step, 360 parts of water was loaded into a reaction vessel equipped with a thermometer and a stirring machine, and 17 parts of hydrochloric acid having a concentration of 5.0 mass % was added to the reaction vessel to provide a homogeneous solution. 136 parts of methyltrimethoxysilane was added to the solution under stirring at a temperature of 25° C., and the resultant was stirred for 5 hours and then filtered, to thereby provide a transparent reaction liquid containing a silanol compound or a partial condensate thereof.

In a second step, 540 parts of water was loaded into a reaction vessel equipped with a thermometer, a stirring machine, and a dropping device, and 19 parts of ammonia water having a concentration of 10.0 mass % was added to the reaction vessel to provide a homogeneous solution. While the solution was stirred at a temperature of 30° C., 100 parts of the reaction liquid obtained in the first step was added dropwise to the solution over 0.60 hour, and the mixture was stirred for 6 hours to provide a suspension. The resultant suspension was subjected to a centrifuge to sediment fine particles, and the fine particles were taken out and dried in a dryer at a temperature of 180° C. for 24 hours to provide organosilicon polymer particles 1.

<Preparation of Organosilicon Polymer Fine Particles 2 to 11>

Organosilicon polymer fine particles 2 to 11 were obtained in the same manner as in the preparation of the organosilicon polymer fine particle 1 except that the number of parts shown in Table 4 was used and the production conditions were changed as shown in Table 4.

TABLE 4

| Organosilicon polymer particle | First step: Addition amount (parts): Kind | First step: Addition amount (parts): Number of parts of silane | First step: Addition amount (parts): Water | First step: Hydrochloric acid | First step: Reaction temperature | Second step: Addition amount (parts): Reaction liquid obtained in first step | Second step: Addition amount (parts): Water | Second step: Addition amount (parts): Ammonia water | Second step: Additionally added in second step: Kind | Second step: Additionally added in second step: Number of parts of silane |
|---|---|---|---|---|---|---|---|---|---|---|
| Organosilicon polymer particle 1 | Methyltrimethoxysilane | 136 | 360 | 17 | 25° C. | 100 | 540 | 19 | Not added | |
| Organosilicon polymer particle 2 | Hexyltrimethoxysilane | 136 | 360 | 17 | 25° C. | 100 | 540 | 17 | Not added | |
| Organosilicon polymer particle 3 | Phenyltrimethoxysilane | 136 | 360 | 17 | 25° C. | 100 | 540 | 23 | Not added | |
| Organosilicon polymer particle 4 | Methyltrimethoxysilane | 136 | 360 | 17 | 25° C. | 100 | 540 | 13 | Not added | |
| Organosilicon polymer particle 5 | Methyltrimethoxysilane | 136 | 360 | 17 | 25° C. | 100 | 540 | 27 | Not added | |
| Organosilicon polymer particle 6 | Methyltrimethoxysilane | 136 | 360 | 17 | 25° C. | 100 | 540 | 10 | Tetramethoxysilane | 5 |
| Organosilicon polymer particle 7 | Methyltrimethoxysilane | 136 | 360 | 17 | 25° C. | 100 | 540 | 35 | Not added | |
| Organosilicon polymer particle 8 | Methyltrimethoxysilane | 136 | 360 | 17 | 25° C. | 100 | 540 | 19 | Tetramethoxysilane | 2 |
| Organosilicon polymer particle 9 | Methyltrimethoxysilane | 136 | 360 | 17 | 25° C. | 100 | 540 | 19 | Tetramethoxysilane | 5 |
| Organosilicon polymer particle 10 | Methyltrimethoxysilane | 136 | 360 | 17 | 25° C. | 100 | 540 | 5 | Not added | |
| Organosilicon polymer particle 11 | Methyltrimethoxysilane | 136 | 360 | 17 | 25° C. | 100 | 540 | 19 | Not added | |

| Organosilicon polymer particle | Second step: Kind | Second step: Reaction temperature | Second step: Dropping time (min) | Second step: Reaction time (hour) | T1 + T2 area ratio | T1 area ratio | T2 area ratio | T3 area ratio | Content of silanol structure (mass %) | Long diameter of organosilicon polymer particle (nm) |
|---|---|---|---|---|---|---|---|---|---|---|
| Organosilicon polymer particle 1 | Methyltrimethoxysilane | 30° C. | 35 | 4 | 0.22 | 0.00 | 0.22 | 0.78 | 100 | 90 |
| Organosilicon polymer particle 2 | Hexyltrimethoxysilane | 30° C. | 60 | 4 | 0.20 | 0.01 | 0.19 | 0.80 | 100 | 50 |
| Organosilicon polymer particle 3 | Phenyltrimethoxysilane | 55° C. | 25 | 4 | 0.15 | 0.00 | 0.15 | 0.85 | 100 | 200 |
| Organosilicon polymer particle 4 | Methyltrimethoxysilane | 30° C. | 90 | 4 | 0.10 | 0.00 | 0.10 | 0.90 | 100 | 30 |
| Organosilicon polymer particle 5 | Methyltrimethoxysilane | 60° C. | 12 | 4 | 0.22 | 0.00 | 0.22 | 0.78 | 100 | 300 |
| Organosilicon polymer particle 6 | Methyltrimethoxysilane | 30° C. | 120 | 1 | 0.40 | 0.10 | 0.30 | 0.50 | 100 | 20 |
| Organosilicon polymer particle 7 | Methyltrimethoxysilane | 30° C. | 5 | 4 | 0.15 | 0.00 | 0.15 | 0.85 | 100 | 400 |
| Organosilicon polymer particle 8 | Methyltrimethoxysilane | 30° C. | 35 | 3 | 0.22 | 0.02 | 0.20 | 0.78 | 98 | 90 |
| Organosilicon polymer particle 9 | Methyltrimethoxysilane | 30° C. | 35 | 3 | 0.22 | 0.04 | 0.18 | 0.78 | 95 | 90 |

TABLE 4-continued

| | | | | | | | | | | |
|---|---|---|---|---|---|---|---|---|---|---|
| Organosilicon polymer particle 10 | Methyltrimethoxysilane | 30° C. | 35 | 1 | 0.45 | 0.15 | 0.40 | 0.35 | 100 | 90 |
| Organosilicon polymer particle 11 | Methyltrimethoxysilane | 60° C. | 35 | 10 | 0.08 | 0.00 | 0.08 | 0.92 | 100 | 90 |

<Production Examples of Toner Particle>

<Toner Particle 1>

The pH of the toner base particle-dispersed liquid 1 was adjusted to 1.5 with 1 mol/L hydrochloric acid, and the mixed liquid was stirred for 1.0 hour. After that, the mixed liquid was filtered while being washed with ion-exchanged water, followed by drying. The resultant powder was classified with an air classifier to provide toner particles 1.

The toner particle 1 had a number-average particle diameter (D1) of 6.2 μm, a weight-average particle diameter (D4) of 6.7 μm, and an average circularity of 0.985.

<Toner Particle 2>

The following materials were weighed, and mixed and dissolved.

| | |
|---|---|
| Styrene | 70.0 parts |
| n-Butyl acrylate | 25.1 parts |
| Acrylic acid | 1.3 parts |
| Hexanediol diacrylate | 0.4 part |
| n-Lauryl mercaptan | 3.2 parts |

A 10% aqueous solution of Neogen RK (manufactured by DKS Co. Ltd.) was added to the above-mentioned solution and dispersed therein. Further, an aqueous solution prepared by dissolving 0.15 part of potassium persulfate in 10.0 parts of ion-exchanged water was added to the resultant while being slowly stirred for additional 10 minutes.

After purging with nitrogen, emulsion polymerization was performed at a temperature of 70° C. for 6.0 hours. After the completion of the polymerization, the reaction liquid was cooled to room temperature, and ion-exchanged water was added to the resultant to provide a resin particle-dispersed liquid having a solid content concentration of 12.5% and a number-average particle diameter of 0.2 μm.

The following materials were weighed and mixed.

| | |
|---|---|
| Releasable wax: HNP-9 (melting point: 76° C., manufactured by Nippon Seiro Co., Ltd.) | 15.0 parts |
| Thermoplastic wax: ethylene glycol distearate | 45.0 parts |
| Tonic surfactant: Neogen RK (manufactured by DKS Co. Ltd.) | 2.0 parts |
| Ton-exchanged water | 240.0 parts |

The above-mentioned materials were heated to 100° C. and sufficiently dispersed with ULTRA-TURRAX T 50 manufactured by IKA Japan K.K. After that, the resultant was heated to 115° C. and subjected to dispersion treatment for 1 hour with a pressure discharge-type Gaulin homogenizer, to thereby provide a release agent particle-dispersed liquid having a volume-average particle diameter of 150 nm and a solid content of 20%.

The following materials were weighed and mixed.

| | |
|---|---|
| C.I. Pigment Blue 15:3 | 45.0 parts |
| Neogen RK | 5.0 parts |
| Ion-exchanged water | 190.0 parts |

The above-mentioned components were mixed and dispersed with a homogenizer (ULTRA-TURRAX manufactured by IKA Japan K.K.) for 10 minutes. After that, the resultant was subjected to dispersion treatment at a pressure of 250 MPa for 20 minutes with ULTIMIZER (counter collision-type wet pulverizer, manufactured by Sugino Machine Limited) to provide a colorant particle-dispersed liquid having a volume-average particle diameter of colorant particles of 120 nm and a solid content of 20%.

| | |
|---|---|
| Resin particle-dispersed liquid | 160.0 parts |
| Wax particle-dispersed liquid | 33.4 parts |
| Colorant particle-dispersed liquid | 14.4 parts |
| Magnesium sulfate | 0.3 part |

The above-mentioned materials were dispersed with a homogenizer (manufactured by IKA Japan K.K.) and then heated to 65° C. under stirring. After stirring at 65° C. for 1.0 hour, the resultant was observed with an optical microscope. It was recognized that aggregate particles having a number-average particle diameter of 6.0 μm were formed. 2.5 Parts of Neogen RK (manufactured by DKS Co. Ltd.) was added to the resultant. After that, the mixture was heated to 80° C. and stirred for 2.0 hours, to thereby provide fused colored resin particles.

After cooling, the resultant was filtered, and the solid separated by the filtration was washed with 2,500.0 parts of ion-exchanged water under stirring for 1.0 hour. The dispersion liquid containing the colored resin was filtered and then dried. The obtained powder was classified with an air classifier to provide toner particles 2. The toner particles 2 had a number-average particle diameter (D1) of 6.2 μm and a weight-average particle diameter (D4) of 6.7 μm.

<Toner Particle 3>

| | |
|---|---|
| Styrene-n-butyl acrylate copolymer serving as a binder resin: (styrene-n-butyl acrylate copolymerization ratio = 70:30, Mp = 22,000, Mw = 3 5,000, Mw/Mn = 2.4) | 100.0 parts |
| C.I. Pigment Blue 15: | 6.5 parts |
| Amorphous polyester resin (condensate of terephthalic acid and propylene oxide-modified bisphenol A, Mw: 7,800, Tg: 70° C., acid value: 8.0 mgKOH/g) | 5.0 parts |
| Releasable wax: HNP-9 (melting point: 76° C., manufactured by Nippon Seiro Co., Ltd.): | 5.0 parts |
| Plastic wax: ethylene glycol distearate | 10.0 parts |

After the above-mentioned materials were premixed with an FM mixer (manufactured by Nippon Coke & Engineering Co., Ltd.), the mixture was melt-kneaded with a twin-screw kneader (model PCM-30, manufactured by Ikegai Ironworks Corp.) to provide a kneaded product. The resultant kneaded product was cooled, coarsely pulverized with a hammer mill (manufactured by Hosokawa Micron Corporation), and then pulverized with a mechanical pulverizer (T-250, manufactured by Freund-Turbo Corporation), to thereby provide finely pulverized powder. The resultant finely pulverized powder was classified with a multi-division classifier (model EJ-L-3, manufactured by Nittetsu Mining Co., Ltd.) utilizing the Coanda effect to provide toner particles 3. The toner particles 3 had a number-average particle diameter (D1) of 6.2 μm and a weight-average particle diameter (D4) of 6.7 μm.

<Production Example 1 of Toner>

100 Parts of the toner particles 1 and 2.0 parts of the organosilicon polymer fine particles 1 were mixed with a Henschel mixer (manufactured by Mitsui Miike Machinery Co., Ltd.) for 5 minutes to provide a toner 1. The jacket temperature of the Henschel mixer was set to 10° C., and the peripheral speed of a rotating blade was set to 38 m/sec.

<Production Examples 2 to 13, 16, and 17 of Toner>

Toners 2 to 13, and toners 16 and 17 were obtained in the same manner as in the production of the toner 1 except that the kind of the toner particles and the organosilicon polymer fine particles were changed in accordance with Table 5 in Production Example 1 of the toner.

<Production Example 14 of Toner>

<Production Example of Organosilicon Compound Liquid 1>

| | |
|---|---|
| Ion-exchanged water | 70.0 parts |
| Methyltriethoxysilane | 30.0 parts |

The above-mentioned materials were weighed into a 200 mL beaker, and the pH thereof was adjusted to 3.5 with 10% hydrochloric acid. After that, the mixture was stirred for 1.0 hour while the temperature was adjusted to 30° C. in a water bath to prepare an organosilicon compound liquid 1. The following samples were weighed into a reaction vessel and mixed with a propeller stirring blade.

| | |
|---|---|
| Toner base particle-dispersed liquid 1 | 500.0 parts |
| Organosilicon compound liquid 1 | 35.0 parts |

Next, the pH of the resultant mixed liquid was adjusted to 6.0 through use of a 1 mol/L NaOH aqueous solution. The temperature of the mixed liquid was set to 50° C., and then, the mixed liquid was held for 1.0 hour while being mixed with the propeller stirring blade. After that, the pH of the mixed liquid was adjusted to 9.5 through use of a 1 mol/L NaOH aqueous solution, and the mixed liquid was held for 4.0 hours. The temperature was decreased to 25° C., and then, the pH was adjusted to 1.5 with 1 mol/L hydrochloric acid. The resultant was stirred for 1.0 hour, and then filtered while being washed with ion-exchanged water, followed by drying. The resultant powder was classified with an air classifier to provide a toner 14. The toner 14 had a number-average particle diameter (D1) of 6.2 μm and a weight-average particle diameter (D4) of 6.7 μm. The physical property values of the resultant toner 14 are shown in Table 5.

<Production Example 15 of Toner>

The following samples were weighed into a reaction vessel and mixed with a propeller stirring blade.

| | |
|---|---|
| Toner base particle-dispersed liquid 1 | 500.0 parts |
| Organosilicon compound liquid 1 | 35.0 parts |

Next, the pH of the resultant mixed liquid was adjusted to 6.0 through use of a 1 mol/L NaOH aqueous solution. The temperature of the mixed liquid was set to 45° C., and then, the mixed liquid was held for 1.0 hour while being mixed with the propeller stirring blade. After that, the pH of the mixed liquid was adjusted to 8.0 through use of a 1 mol/L NaOH aqueous solution, and the resultant was held for 4.0 hours.

The temperature was decreased to 25° C., and then, the pH was adjusted to 1.5 with 1 mol/L hydrochloric acid. The resultant was stirred for 1.0 hour, and then filtered while being washed with ion-exchanged water, followed by drying. The resultant powder was classified with an air classifier to provide a toner 15. The toner 15 had a number-average particle diameter (D1) of 6.2 μm and a weight-average particle diameter (D4) of 6.7 μm. The physical property values of the resultant toner 15 are shown in Table 5.

<Production Example 18 of Toner>

The following samples were weighed into a reaction vessel and mixed with a propeller stirring blade.

| | |
|---|---|
| Toner base particle-dispersed liquid 1 | 500.0 parts |
| Organosilicon compound liquid 1 | 35.0 parts |

Next, the pH of the resultant mixed liquid was adjusted to 6.0 through use of a 1 mol/L NaOH aqueous solution. The temperature of the mixed liquid was set to 45° C., and then, the mixed liquid was held for 1.0 hour while being mixed with the propeller stirring blade. After that, the pH of the mixed liquid was adjusted to 7.0 through use of a 1 mol/L NaOH aqueous solution, and the mixed liquid was held for 4.0 hours. The temperature was decreased to 25° C., and then, the pH was adjusted to 1.5 with 1 mol/L hydrochloric acid. The resultant was stirred for 1.0 hour, and then filtered while being washed with ion-exchanged water, followed by drying. The resultant powder was classified with an air classifier to provide a toner 18. The toner 18 had a number-average particle diameter (D1) of 6.2 μm and a weight-average particle diameter (D4) of 6.7 μm. The physical property values of the resultant toner 18 are shown in Table 5.

<Production Example 19 of Toner>

100 parts of the toner particles 1, 2.0 parts of the organosilicon polymer fine particles 1, and 1.0 part of silica particles having a number-average particle diameter of 100 nm were mixed with a Henschel mixer (manufactured by Mitsui Miike Machinery Co., Ltd.) for 5 minutes to provide a toner 19. The jacket temperature of the Henschel mixer was set to 10° C., and the peripheral speed of a rotating blade was set to 38 m/sec.

TABLE 5

| Toner | Toner particle | Organosilicon polymer particle | T1 + T2 area ratio | T1 area ratio | T2 area ratio | T3 area ratio | Content of silanol structure (mass %) | Long diameter of organosilicon polymer particle (nm) | Sticking rate | Toner average circularity |
|---|---|---|---|---|---|---|---|---|---|---|
| Toner 1 | Toner particle 1 | Organosilicon polymer particle 1 | 0.22 | 0.00 | 0.22 | 0.78 | 100 | 90 | 15 | 0.985 |
| Toner 2 | Toner particle 1 | Organosilicon polymer particle 2 | 0.20 | 0.01 | 19.00 | 0.80 | 100 | 50 | 15 | 0.985 |
| Toner 3 | Toner particle 1 | Organosilicon polymer particle 3 | 0.15 | 0.00 | 15.00 | 0.85 | 100 | 200 | 15 | 0.985 |
| Toner 4 | Toner particle 1 | Organosilicon polymer particle 4 | 0.10 | 0.00 | 0.10 | 0.90 | 100 | 300 | 15 | 0.985 |
| Toner 5 | Toner particle 1 | Organosilicon polymer particle 5 | 0.22 | 0.00 | 0.22 | 0.78 | 100 | 30 | 15 | 0.985 |
| Toner 6 | Toner particle 1 | Organosilicon polymer particle 6 | 0.40 | 0.10 | 0.30 | 0.50 | 100 | 20 | 20 | 0.985 |
| Toner 7 | Toner particle 1 | Organosilicon polymer particle 7 | 0.15 | 0.00 | 0.15 | 0.85 | 100 | 400 | 10 | 0.985 |
| Toner 8 | Toner particle 2 | Organosilicon polymer particle 1 | 0.22 | 0.00 | 0.22 | 0.78 | 100 | 90 | 15 | 0.950 |
| Toner 9 | Toner particle 3 | Organosilicon polymer particle 1 | 0.22 | 0.00 | 0.22 | 0.78 | 100 | 90 | 15 | 0.930 |
| Toner 10 | Toner particle 1 | Organosilicon polymer particle 8 | 0.22 | 0.02 | 0.20 | 0.78 | 98 | 90 | 15 | 0.985 |
| Toner 11 | Toner particle 1 | Organosilicon polymer particle 9 | 0.22 | 0.04 | 0.18 | 0.78 | 95 | 90 | 15 | 0.985 |
| Toner 12 | Toner particle 1 | Organosilicon polymer particle 1 | 0.22 | 0.00 | 0.22 | 0.78 | 100 | 90 | 25 | 0.985 |
| Toner 13 | Toner particle 1 | Organosilicon polymer particle 1 | 0.22 | 0.00 | 0.22 | 0.78 | 100 | 90 | 40 | 0.985 |
| Toner 14 | Toner particle 4 | — | 0.22 | 0.00 | 0.22 | 0.78 | 100 | — | — | 0.985 |
| Toner 15 | Toner particle 5 | — | 0.40 | 0.03 | 0.37 | 0.60 | 100 | — | — | 0.985 |
| Toner 16 | Toner particle 1 | Organosilicon polymer particle 10 | 0.45 | 0.15 | 0.40 | 0.35 | 100 | 90 | 15 | 0.985 |
| Toner 17 | Toner particle 1 | Organosilicon polymer particle 11 | 0.08 | 0.00 | 0.08 | 0.92 | 100 | 90 | 15 | 0.985 |
| Toner 18 | Toner particle 6 | — | 0.45 | 0.05 | 0.40 | 0.55 | 100 | — | — | 0.985 |
| Toner 19 | Toner particle 1 | Organosilicon polymer particle 1 | 0.22 | 0.00 | 0.22 | 0.78 | 100 | 90 | 15 | 0.985 |

<Evaluation>

A reconstructed machine of LBP712Ci (manufactured by Canon Inc.) was used as an image forming apparatus. The process speed of a main body was modified to 320 mm/sec. Then, required adjustments were made so that image formation was able to be performed under those conditions. In addition, a toner was removed from a cyan cartridge, and instead, 100 g of each of toners to be evaluated was filled into the cyan cartridge. Further, an electrophotographic photosensitive member was changed to the electrophotographic photosensitive member 1 according to the present invention. The toner cartridge thus prepared was mounted to a black station, and dummy cartridges were mounted to the other stations. The following image output test was performed. The evaluation results are shown in Table 6.

<Evaluation of Coarseness in Halftone>

After an image having a print percentage of 1% in horizontal lines was printed out on 1,000 sheets under a high-temperature and high-humidity environment (temperature: 30.0° C./humidity: 80% RH), a halftone image was output, and the fineness thereof was visually evaluated. Then, after an image having a print percentage of 1% in horizontal lines was printed out on 10,000 sheets, a halftone image was output, and the fineness thereof was visually evaluated. Canon color laser copier paper (A4: 81.4 g/m$^2$, this paper is hereinafter used unless otherwise stated) was used as evaluation paper.

(Evaluation Criteria)

A: The image is uniformly fine.

B: The image is slightly blurred.

C: The image is blurred.

D: A coarse defective image with conspicuous difference in density is generated.

<Fogging Evaluation 1>

After an image having a print percentage of 1% in horizontal lines was printed out on 10,000 sheets under a low-temperature and low-humidity environment (temperature: 15° C./humidity: 10% RH) and a high-temperature and high-humidity environment (temperature: 30° C./humidity: 80% RH), the sheets were allowed to stand for 48 hours. Further, the reflectance (%) of a non-image portion of the printed image having a print percentage of 1% in horizontal lines was measured with a "REFLECTOMETER MODEL TC-6DS" (manufactured by Tokyo Denshoku Co., Ltd.). The resultant reflectance was evaluated through use of a numerical value (%) subtracted from the reflectance (%) of unused print paper (standard paper) measured in the same manner. When the numerical value is smaller, image fogging is more suppressed. The evaluation was performed in a gloss paper mode through use of plain paper (HP Brochure Paper 200 g, Glossy, manufactured by Hewlett-Packard Company, 200 g/m$^2$).

(Evaluation Criteria)

A: 0.5% or less

B: More than 0.5% and 1.5% or less

C: More than 1.5% and 3.0% or less

D: More than 3.0%

<Fogging Evaluation 2>

After an image having a print percentage of 1% in horizontal lines was printed out on 12,000 sheets under a high-temperature and high-humidity environment (temperature: 30° C./humidity: 80% RH), the sheets were allowed to stand for 48 hours. Further, the reflectance (%) of a non-image portion of the printed image having a print percentage of 1% in horizontal lines was measured with a "REFLECTOMETER MODEL TC-6DS" (manufactured by Tokyo Denshoku Co., Ltd.). The evaluation was performed by the same method with the same evaluation criteria as those in Fogging Evaluation 1.

<Evaluation of Transferability (Transfer Efficiency)>

Transfer efficiency is an indicator of transferability that indicates what percentage of the toner developed onto the photosensitive drum has been transferred onto an intermediate transfer belt. The transfer efficiency was evaluated by continuously forming a solid image on recording media.

First, the measurement was performed under a low-temperature and low-humidity environment (temperature: 15° C., humidity: 10% RH) by printing out an image having a print percentage of 1% in horizontal lines on 1,000 sheets, and then continuously forming a solid image on 10 recording media.

After the image was formed on the 10 recording media, the toner transferred onto the intermediate transfer belt and the toner remaining on the photosensitive drum after transfer were each removed with a transparent pressure-sensitive adhesive tape made of polyester. The density difference obtained by subtracting the density in the case where only the pressure-sensitive adhesive tape was bonded to paper from the toner density in the case where the pressure-sensitive adhesive tape used for removing the toner was bonded to paper was calculated for the respective toners. The transfer efficiency is the ratio of the toner density difference on the intermediate transfer belt when the sum of the respective toner density differences is set to 100. When this ratio is higher, the transfer efficiency is more excellent. The evaluation of the transfer efficiency was performed in accordance with the following criteria. The toner density was measured with an X-Rite color reflection densitometer (500 series).

A: The transfer efficiency is 95% or more.

B: The transfer efficiency is 90% or more and less than 95%.

C: The transfer efficiency is less than 90%.

TABLE 6

| | | | Coarseness evaluation | | | | | |
|---|---|---|---|---|---|---|---|---|
| | | | After printing on | After printing on | Fogging evaluation 1 | | Fogging evaluation 2 | |
| | Electrophotographic photosensitive member | Toner | 1,000 sheets | 10,000 sheets | HH fogging | LL fogging | HH fogging | Transfer efficiency |
| Example 1 | Electrophotographic photosensitive member 1 | Toner 1 | A | A | 0.3 | 0.3 | 0.4 | 98 |
| Example 2 | Electrophotographic photosensitive member 2 | Toner 1 | A | A | 0.3 | 0.2 | 0.3 | 98 |
| Example 3 | Electrophotographic photosensitive member 3 | Toner 1 | C | C | 0.5 | 1.1 | 0.5 | 97 |
| Example 4 | Electrophotographic photosensitive member 4 | Toner 1 | A | A | 0.4 | 0.4 | 0.5 | 98 |
| Example 5 | Electrophotographic photosensitive member 5 | Toner 1 | A | A | 0.4 | 0.5 | 0.4 | 98 |
| Example 6 | Electrophotographic photosensitive member 6 | Toner 1 | B | B | 0.8 | 0.8 | 0.9 | 98 |
| Example 7 | Electrophotographic photosensitive member 7 | Toner 1 | B | B | 0.9 | 1.2 | 1.0 | 97 |
| Example 8 | Electrophotographic photosensitive member 8 | Toner 1 | C | C | 1.4 | 1.3 | 1.5 | 96 |
| Example 9 | Electrophotographic photosensitive member 9 | Toner 1 | C | C | 0.8 | 0.9 | 0.9 | 98 |
| Example 10 | Electrophotographic photosensitive member 10 | Toner 1 | B | B | 0.4 | 0.4 | 0.5 | 97 |
| Example 11 | Electrophotographic photosensitive member 11 | Toner 1 | A | A | 0.3 | 0.3 | 0.4 | 97 |
| Example 12 | Electrophotographic photosensitive member 12 | Toner 1 | A | A | 0.4 | 0.5 | 0.5 | 98 |
| Example 13 | Electrophotographic photosensitive member 13 | Toner 1 | A | A | 0.5 | 0.5 | 0.5 | 98 |
| Example 14 | Electrophotographic photosensitive member 14 | Toner 1 | B | B | 0.5 | 0.5 | 1.6 | 97 |
| Example 15 | Electrophotographic photosensitive member 15 | Toner 1 | B | C | 0.7 | 0.9 | 1.6 | 97 |
| Example 16 | Electrophotographic photosensitive member 16 | Toner 1 | B | C | 0.8 | 1.1 | 1.8 | 96 |
| Example 17 | Electrophotographic photosensitive member 17 | Toner 1 | C | C | 1.2 | 1.5 | 2.0 | 95 |
| Example 18 | Electrophotographic photosensitive member 1 | Toner 2 | A | A | 0.3 | 0.3 | 0.4 | 98 |
| Example 19 | Electrophotographic photosensitive member 1 | Toner 3 | A | A | 0.4 | 0.4 | 0.5 | 98 |
| Example 20 | Electrophotographic photosensitive member 1 | Toner 4 | B | B | 0.7 | 1.1 | 0.8 | 97 |
| Example 21 | Electrophotographic photosensitive member 1 | Toner 5 | A | A | 0.5 | 0.9 | 0.6 | 94 |

TABLE 6-continued

| | Electrophotographic photosensitive member | Toner | Coarseness evaluation: After printing on 1,000 sheets | Coarseness evaluation: After printing on 10,000 sheets | Fogging evaluation 1: HH fogging | Fogging evaluation 1: LL fogging | Fogging evaluation 2: HH fogging | Transfer efficiency |
|---|---|---|---|---|---|---|---|---|
| Example 22 | Electrophotographic photosensitive member 1 | Toner 6 | B | C | 2.2 | 1.8 | 2.5 | 93 |
| Example 23 | Electrophotographic photosensitive member 1 | Toner 7 | B | C | 1.2 | 1.7 | 1.4 | 95 |
| Example 24 | Electrophotographic photosensitive member 1 | Toner 8 | A | A | 0.3 | 0.5 | 0.4 | 97 |
| Example 25 | Electrophotographic photosensitive member 1 | Toner 9 | B | B | 0.8 | 1.2 | 0.8 | 93 |
| Example 26 | Electrophotographic photosensitive member 1 | Toner 10 | A | A | 0.4 | 0.4 | 0.5 | 98 |
| Example 27 | Electrophotographic photosensitive member 1 | Toner 11 | B | C | 1.4 | 1.3 | 1.6 | 94 |
| Example 28 | Electrophotographic photosensitive member 1 | Toner 12 | A | A | 1.0 | 1.8 | 1.2 | 93 |
| Example 29 | Electrophotographic photosensitive member 1 | Toner 13 | B | C | 2.3 | 2.5 | 2.5 | 92 |
| Example 30 | Electrophotographic photosensitive member 1 | Toner 14 | B | C | 1.2 | 1.3 | 1.4 | 92 |
| Example 31 | Electrophotographic photosensitive member 1 | Toner 15 | C | C | 2.3 | 2.0 | 2.6 | 91 |
| Example 32 | Electrophotographic photosensitive member 23 | Toner 1 | B | B | 1.0 | 1.2 | 1.6 | 98 |
| Example 33 | Electrophotographic photosensitive member 24 | Toner 1 | A | B | 0.6 | 0.8 | 0.8 | 97 |
| Example 34 | Electrophotographic photosensitive member 25 | Toner 1 | B | B | 0.8 | 1.2 | 1.5 | 96 |
| Comparative Example 1 | Electrophotographic photosensitive member 18 | Toner 1 | D | D | 2.0 | 2.5 | 2.1 | 94 |
| Comparative Example 2 | Electrophotographic photosensitive member 19 | Toner 1 | D | D | 3.2 | 3.8 | 4.0 | 94 |
| Comparative Example 3 | Electrophotographic photosensitive member 20 | Toner 1 | D | D | 2.4 | 2.3 | 2.6 | 93 |
| Comparative Example 4 | Electrophotographic photosensitive member 21 | Toner 1 | D | D | 2.6 | 4.0 | 3.1 | 93 |
| Comparative Example 5 | Electrophotographic photosensitive member 21 | Toner 19 | D | D | 2.5 | 2.8 | 3.2 | 94 |
| Comparative Example 6 | Electrophotographic photosensitive member 22 | Toner 1 | D | D | 4.2 | 2.3 | 5.0 | 94 |
| Comparative Example 7 | Electrophotographic photosensitive member 1 | Toner 16 | D | D | 3.5 | 2.2 | 3.8 | 89 |
| Comparative Example 8 | Electrophotographic photosensitive member 1 | Toner 17 | D | D | 2.1 | 3.8 | 2.4 | 87 |
| Comparative Example 9 | Electrophotographic photosensitive member 1 | Toner 18 | D | D | 2.3 | 2.5 | 2.5 | 88 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-166515, filed Oct. 8, 2021, Japanese Patent Application No. 2022-129653, filed Aug. 16, 2022, and Japanese Patent Application No. 2022-147173, filed Sep. 15, 2022, which are hereby incorporated by reference herein in their entirety.

What is claimed is:

1. A process cartridge that is detachable from a main body of an electrophotographic apparatus, the process cartridge comprising:

an electrophotographic photosensitive member; and a developing unit, which includes a toner storing portion configured to store a toner, and which is configured to supply the toner to a surface of the electrophotographic photosensitive member, wherein the electrophotographic photosensitive member includes an electroconductive support, and a photosensitive layer and a surface protective layer formed on the electroconductive support in the stated order, wherein the surface protective layer contains an electroconductive particle, wherein a content of the electroconductive particle is 5.0 vol % or more and 70.0 vol % or less with respect to a total volume of the surface protective layer, wherein the surface protective layer has a volume resistivity of $1.0\times10^{9}$ Ω·cm or more and $1.0\times10^{14}$ Ω·cm or less, wherein the toner stored in the toner storing portion satisfies one of the following provision (i) or (ii):

(i) a toner including a toner particle that contains a binder resin and including an organosilicon polymer particle; and (ii) a toner including a toner particle that contains the binder resin and includes an organosilicon polymer on a surface thereof, wherein one of the organosilicon polymer particle in a case of satisfying the provision (i) or the organosilicon polymer in a case of satisfying the provision (ii) includes:

a silicon atom having a T3 unit structure; and at least one unit structure selected from the group consisting of: a silicon atom having a T2 unit structure; and a silicon atom having a T1 unit structure, and wherein, in $^{29}$Si-NMR measurement of one of the organosilicon polymer particle in the case of satisfying the provision (i) or the organosilicon polymer in the case of satisfying the provision (ii), a ratio of a total area of an area of a peak derived from the silicon atom having the T2 unit structure and an area of a peak derived from the silicon atom having the T1 unit structure with respect to a total area of peaks derived from all the silicon atoms is 0.10 or more and 0.40 or less.

2. The process cartridge according to claim 1, wherein, in the $^{29}$Si-NMR measurement of one of the organosilicon polymer particle or the organosilicon polymer, a ratio of an area of a peak derived from the silicon atom having the T3 unit structure with respect to a total area of peaks derived from all the silicon atoms contained in one of the organosilicon polymer particle or the organosilicon polymer is 0.50 or more and 0.90 or less.

3. The process cartridge according to claim 1, wherein the toner is the toner including the toner particle that contains the binder resin and including the organosilicon polymer particle, and wherein the organosilicon polymer particle has a long diameter of 30 nm or more and 300 nm or less.

4. The process cartridge according to claim 3, wherein the organosilicon polymer particle has a sticking rate to the toner particle of 25% or less in a water washing method.

5. The process cartridge according to claim 1, wherein the toner has an average circularity of 0.950 or more and 0.990 or less.

6. The process cartridge according to claim 1, wherein, in one of the organosilicon polymer particle or the organosilicon polymer, a ratio of a content of a silanol structure to sum of a content of an alkoxysilane structure in the T1 unit structure and the T2 unit structure and a content of a silanol structure included in the T1 unit structure and the T2 unit structure is 98 mass % or more.

7. The process cartridge according to claim 1, wherein the electroconductive particle is a titanium oxide particle.

8. The process cartridge according to claim 7, wherein the titanium oxide particle is a niobium atom-containing titanium oxide particle.

9. The process cartridge according to claim 8, wherein, in the niobium atom-containing titanium oxide particle, a concentration ratio calculated as niobium atom concentration/titanium atom concentration at an inside portion at 5% of a maximum diameter of a measurement particle from a surface of the particle is 2.0 times or more as high as a concentration ratio calculated as niobium atom concentration/titanium atom concentration at a central portion of the particle.

10. The process cartridge according to claim 8, wherein the niobium atom-containing titanium oxide particle contains a niobium atom at a content of 2.6 mass % or more and 10.0 mass % or less with respect to a total mass of the niobium atom-containing titanium oxide particle.

11. The process cartridge according to claim 1, wherein the content of the electroconductive particle is 5.0 vol % or more and 40.0 vol % or less with respect to the total volume of the surface protective layer, and wherein the surface protective layer has a volume resistivity of $1.0\times10^{11}$ Ω·cm or more and $1.0\times10^{14}$ Ω·cm or less.

12. The process cartridge according to claim 1, wherein the developing unit is a contact developing device configured to perform development by bringing a toner carrying member carrying the toner into contact with the electrophotographic photosensitive member.

13. An electrophotographic apparatus comprising a process cartridge, the process cartridge including:

an electrophotographic photosensitive member; and a developing unit, which includes a toner storing portion configured to store a toner, and which is configured to supply the toner to a surface of the electrophotographic photosensitive member, wherein the electrophotographic photosensitive member includes an electroconductive support, and a photosensitive layer and a surface protective layer formed on the electroconductive support in the stated order, wherein the surface protective layer contains an electroconductive particle, wherein a content of the electroconductive particle is 5.0 vol % or more and 70.0 vol % or less with respect to a total volume of the surface protective layer, wherein the surface protective layer has a volume resistivity of $1.0\times10^{9}$ Ω·cm or more and $1.0\times10^{14}$ Ω·cm or less, wherein the toner stored in the toner storing portion satisfies one of the following provision (i) or (ii):

(i) a toner including a toner particle that contains a binder resin and including an organosilicon polymer particle; and (ii) a toner including a toner particle that contains the binder resin and includes an organosilicon polymer on a surface thereof, wherein one of the organosilicon polymer particle in a case of satisfying the provision (i) or the organosilicon polymer in a case of satisfying the provision (ii) includes:

a silicon atom having a T3 unit structure; and at least one unit structure selected from the group consisting of: a silicon atom having a T2 unit structure; and a silicon atom having a T1 unit structure, and wherein, in $^{29}$Si-NMR measurement of one of the organosilicon polymer particle in the case of satisfying the provision (i) or the organosilicon polymer in the case of satisfying the provision (ii), a ratio of a total area of an area of a peak derived from the silicon atom having the T2 unit structure and an area of a peak derived from the silicon atom having the T1 unit structure with respect to a total area of peaks derived from all the silicon atoms is 0.10 or more and 0.40 or less.

* * * * *